US007320380B2

(12) United States Patent
Ueda et al.

(10) Patent No.: US 7,320,380 B2
(45) Date of Patent: Jan. 22, 2008

(54) SWIVELING UTILITY MACHINE HAVING SWIVEL DECK

(75) Inventors: Masaaki Ueda, Sakai (JP); Junichi Fujiwara, Osaka (JP); Sakae Sugahara, Kawachinagano (JP)

(73) Assignee: Kubota Corporation, Osaka (JP)

( * ) Notice: Subject to any disclaimer, the term of this patent is extended or adjusted under 35 U.S.C. 154(b) by 458 days.

(21) Appl. No.: 10/945,557

(22) Filed: Sep. 20, 2004

(65) Prior Publication Data

US 2005/0210718 A1 Sep. 29, 2005

(30) Foreign Application Priority Data

Mar. 29, 2004 (JP) ..... 2004-97033
Mar. 29, 2004 (JP) ..... 2004-97034
Mar. 29, 2004 (JP) ..... 2004-097035

(51) Int. Cl.
*B62D 33/08* (2006.01)

(52) U.S. Cl. ..... 180/327; 296/190.08

(58) Field of Classification Search ..... 180/327; 296/190.01, 190.08
See application file for complete search history.

(56) References Cited

U.S. PATENT DOCUMENTS 4,771,855 A * 9/1988 Takashima et al. ..... 180/326
5,671,820 A * 9/1997 Kobayashi et al. ..... 180/68.1
5,711,095 A * 1/1998 Oda et al. ..... 37/410
5,715,615 A * 2/1998 Murakami et al. ..... 37/379
6,009,643 A * 1/2000 Maeba et al. ..... 37/443
6,170,180 B1 * 1/2001 Schaeff ..... 37/443
6,170,588 B1 * 1/2001 Irino et al. ..... 180/89.1
6,430,852 B2 * 8/2002 Murakami ..... 37/466
6,502,896 B1 * 1/2003 Nakata et al. ..... 296/190.05
6,540,036 B1 * 4/2003 Sugano ..... 180/68.1
6,615,942 B2 * 9/2003 Shinohara et al. ..... 180/69.21
6,729,831 B1 * 5/2004 Kawamura et al. ..... 414/694
6,886,277 B2 * 5/2005 Yukawa et al. ..... 37/347
6,922,925 B2 * 8/2005 Watanabe et al. ..... 37/466
6,990,757 B2 * 1/2006 Takemura et al. ..... 37/347
7,021,074 B2 * 4/2006 Hara et al. ..... 62/244

(Continued)

FOREIGN PATENT DOCUMENTS

EP 1 1138 835 A 10/2001

(Continued)

*Primary Examiner*—Faye M. Fleming
(74) *Attorney, Agent, or Firm*—The Webb Law Firm

(57) ABSTRACT

A swiveling utility machine includes a swivel deck, an engine disposed at a rear portion of the swivel deck, a radiator disposed adjacent the engine, a driver's seat, a right implement controller disposed on the right side of the driver's seat and a left implement controller disposed on the left side of the driver's seat. A support frame is disposed at a rear portion of the swivel deck in such a manner as to create a rectangular space inside the swivel deck, the engine being mounted within the rectangular space. The driver' seat is disposed upwardly of the support frame. The right implement controller is secured to a right side of the support frame, and the left implement controller is attached to a left side of the support frame to be switchable in its posture between an operational posture and a retracted posture. An access step is disposed at a front portion of the support frame, and an access entrance is provided on a left side of the access step.

30 Claims, 21 Drawing Sheets

U.S. PATENT DOCUMENTS

2003/0226293 A1* 12/2003 Takemura et al. ..... 37/466
2006/0266573 A1* 11/2006 Ishii et al. ..... 180/326

FOREIGN PATENT DOCUMENTS

JP 02070835 A * 3/1990
JP 09-195316 7/1997
JP 09 268598 10/1997
JP 09 296481 A 11/1997
JP 11-081378 3/1999
JP 11269933 A * 10/1999
JP 2000 038037 2/2000
JP 2000 038743 2/2000
JP 2001-020324 1/2001
JP 2002 061222 A 2/2002
JP 2003 020680 1/2003
JP 2003-074085 3/2003

* cited by examiner

SWIVELING UTILITY MACHINE HAVING SWIVEL DECK

BACKGROUND OF THE INVENTION

1. Field of the Invention

The present invention relates to a swiveling utility machine having a swivel deck, an engine disposed at a rear portion of the swivel deck, a radiator disposed adjacent the engine, a driver's seat, a right implement controller disposed on the right side of the driver's seat and a left implement controller disposed on the left side of the driver's seat.

2. Description of the Related Art

A conventional swiveling utility machine is known from e.g. Japanese Patent Application "Kokai" No. 11-81378. This machine includes an engine disposed at a rear portion of a swivel deck, a radiator disposed on either right or left side of the engine, and a support frame mounted on the swivel deck to be disposed over and across these, with an air cleaner and a muffler being mounted inside the support frame. In the case of this swiveling utility machine, its support frame is constructed as a three-post type including two front posts and one rear post and is mounted over and across the engine. However, as the right and left implement controllers are supported by separate stays, the mounting construction is complicated and assembly thereof is troublesome.

Another swiveling utility machine is known from Japanese Patent Application "Kokai" No. 9-195316. In the case of this machine, a support frame having a rectangular shape in its plan view is mounted forwardly of the engine, and the driver's seat and right and left implement controllers are supported to this support frame. The support frame employed in this swiveling utility machine is constructed as a four-post type and has a rectangular shape in its plan view. Although this support frame can support the driver's seat and the right and left implement controllers, as the frame is disposed separately and forwardly of the engine, it is difficult to form the fore-and-aft size of the swivel deck compact.

Still another swiveling utility machine is known from Japanese Patent Application "Kokai" No. 2003-74085. In this machine, the support frame is disposed across the engine at a rear portion of the swivel deck, with front portions of the engine and frame being covered by a fixed cover. On the top of this fixed cover, the driver's seat is mounted. Further, on the right side of the driver's seat, a right implement controller is disposed and on the left side of the seat, a left implement controller is disposed to be switchable in its posture between an operational posture and a retracted non-operational posture. A radiator is disposed on the right side of the engine. An access step for the driver is formed at a front portion of the fixed cover. In this construction, a left side wall is provided on the left side of the fixed cover, with a front portion of the left side wall projecting from the front face of the fixed cover. And, the left implement controller projects even forwardly from this left side wall and the cover. For this reason, the access step is formed in a rather limited space, making the driver's access to the driver's seat difficult.

Still another swiveling utility machine is known from Japanese Patent Application "Kokai" No. 2001-20324. In this case, a traveling control unit is disposed at a front portion of a swivel deck and an engine is laterally disposed at a rear portion of the swivel deck. A support base for supporting a driver's seat is provided forwardly of the engine. A radiator is disposed on one side of the engine close to an access entrance. Further, a hydraulic pump is disposed on the other side of the engine distant from the access entrance. The driver's seat and right and left implement controllers are disposed forwardly of the engine. In the case of this construction, as the right and left implement controllers are disposed forwardly of the engine, an upper structure of the swivel deck is formed elongate in the fore and aft direction.

SUMMARY OF THE INVENTION

A primary object of the present invention is to provide a swiveling utility machine which has a swivel deck formed compact in the fore and aft direction and which yet allows easy mounting of right and left implement controllers, through ingenious layout of the support frame and right and left implement controllers.

For accomplishing the above-noted object, according to the present invention, there is proposed a swiveling utility machine having a swivel deck comprising:

a support frame disposed at a rear portion of the swivel deck in such a manner as to create a rectangular space inside the swivel deck;

an engine mounted within the rectangular space;

a driver' seat disposed upwardly of the support frame;

a radiator disposed adjacent the engine;

a right implement controller secured to a right side of the support frame;

a left implement controller attached to a left side of the support frame to be switchable in its posture between an operational posture and a retracted posture;

an access step disposed at a front portion of the support frame; and an access entrance provided on a left side of the access step.

With the above construction, the support frame mounting the right and left implement controllers can be disposed across and over the engine. Therefore, the assembly of e.g. the right and left implement controllers can be very easily carried out, while the swivel deck is formed compact in the fore and aft direction.

According to one preferred embodiment of the present invention, a fixed cover is attached to a front face of the support frame, a side cover for covering the radiator is attached to the left side of the support frame, and a front face of the side cover, the front face of the fixed cover and the front face of the left implement controller at its retracted posture are arranged side by side substantially in a same plane. With this construction, the front face of the fixed cover, as a raised wall on the rear side of the step, the front face of the side cover and the front face of the left implement controller are arranged substantially flush with little unevenness, so that the step can be formed wider for facilitating the driver's access to the driver's seat.

Preferably, a lower pivot portion of the left implement controller is disposed inside the side cover. With this, the lower pivot portion of the left implement controller can be covered by the side cover and also the left implement controller can be disposed as close as possible to the left side face of the swivel deck, so that the swivel deck may be formed compact in the right/left direction.

Still preferably, a support stay extending over and across the radiator projects from the left side of the support frame, and the lower pivot portion of the left implement controller is supported at a portion of the support stay on the outside of the radiator. With this construction, the radiator and the left implement controller can be supported easily and reliably. Moreover, the left implement controller can be arranged at a position appropriate in the right/left direction and at an appropriate height, without being interfered with by the radiator.

According to another preferred embodiment of the present invention, on the side of the engine opposite to the access entrance, a hydraulic pump is disposed and a working oil tank and a fuel tank are disposed forwardly of the hydraulic pump and laterally of the driver's seat. With this, the upper structure of the swivel deck may be formed compact in the fore and aft direction, so that the entire swiveling utility machine can be formed even more compact.

Preferably, a front face and an upper face of the engine are covered by a fixed cover and a rear face of the engine is covered by an openable/closable hood cover, an air-inlet side of the radiator is covered by an openable/closable side cover, and the hydraulic pump, the working oil tank and the fuel tank are covered by a tank cover. This construction facilitates maintenance of the upper structure of the swivel deck.

Further and other features and advantages of the present invention will become apparent upon reading the following detailed description of the present invention with reference to the accompanying drawings.

DESCRIPTION OF THE PREFERRED EMBODIMENTS

Figure 1:
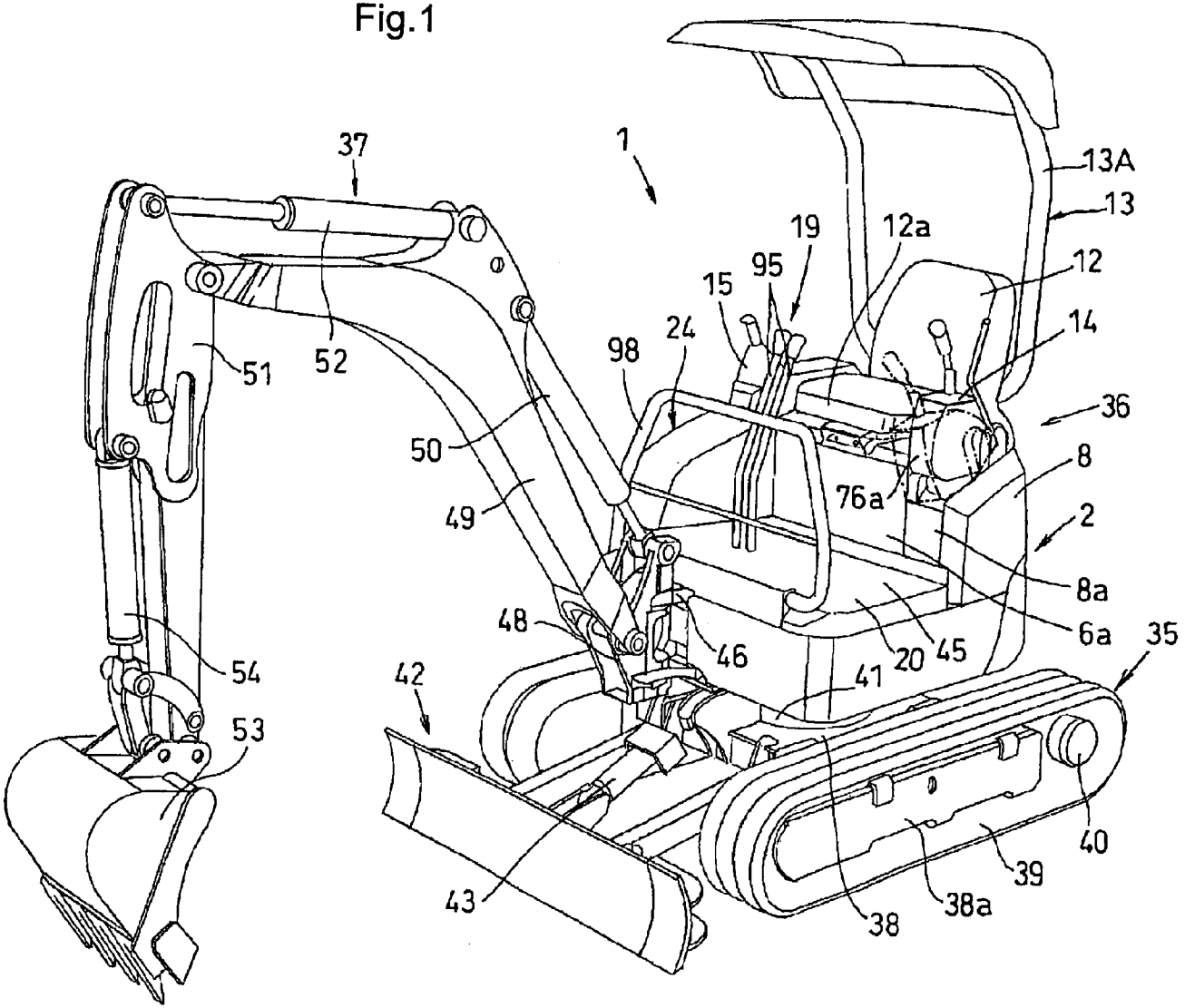
FIG. 1 is a perspective view showing an entire swiveling utility machine relating to the present invention as viewed from the left front side thereof.
Figure 2:
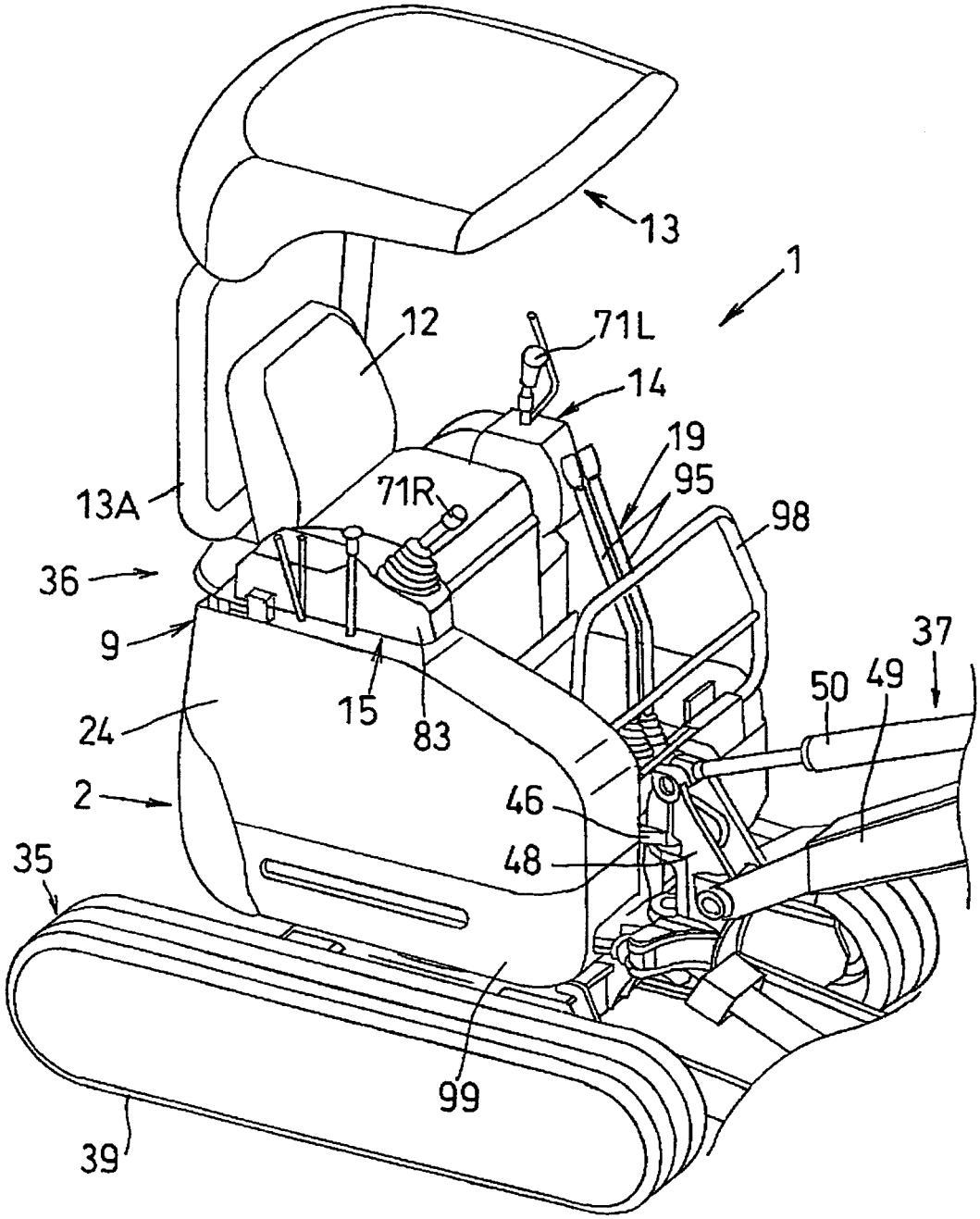
FIG. 2 is a perspective view of the same as viewed from the right front side thereof.

Preferred embodiments of the present invention will be described in details with reference to the accompanying drawings.

In FIGS. 1 through 12, numeral 1 denotes a standard or compact rear swiveling type backhoe as an example of the swiveling utility machine relating to the present invention. This backhoe 1 includes, as principal components thereof, a pair of right and left crawler traveling units 35, an upper structure 36 having a swivel deck 2, an excavator 37 mounted on the swivel deck 2, and a dozer 42 disposed forwardly of the crawler traveling units 35.

The crawler traveling units 35 include track frames 38 having a pair of right and left side frames 38*a*, each side frame 38*a* rotatably supporting drive and driven wheels at fore and aft portions and a plurality of free wheels therebetween. A crawler 39 formed of rubber or iron is entrained about these wheels. The drive wheels are driven by traveling drive units such as a pair of right and left hydraulic motors 40.

The track frames 38 support the right and left frames 38*a* with allowing displacement thereof in the right/left direction by means of a hydraulic cylinder. The right and left crawler traveling units 35 are configured to allow widening/narrowing change in an inter-track distance.

When the crawler traveling units 35 are set at their widest inter-track distance, a distance L1 from a swivel axis X (shown in FIGS. 6, 7 and 11) to an outer end of each of the right and left crawler traveling units 35 is about same as or slightly greater than the maximum turning radius of the swivel deck 2. The distance L1 can be about 10% greater than the maximum turning radius.

When the crawler traveling units 35 are set at their narrowest inter-track distance, a distance L2 from the swivel axis X to the outer end of each of the right and left crawler traveling units 35 is about same as or slightly greater than a distance from the swivel axis X to each right/left side face of the swivel deck 2 under its forwardly oriented posture. The distance L2 can be about 10% greater than the latter distance.

The track frames 38 mount thereon the swivel deck 2 via a swivel bearing 41, so that the swivel deck 2 can be swiveled in the right/left direction about the swivel axis X by a swivel motor 44. To the front of the track frames 38, the dozer 42 is attached via a dozer cylinder 43 to be lifted up/down.

In FIGS. 1-14, the swivel deck 2 mounts thereon, an engine 3, a radiator 5, a hydraulic pump 21 driven by the engine 3, a working oil tank 22, a fuel tank 23, a cover 9 covering these components, a driver's seat 12 and right and left implement controllers 14, 15 which are disposed on this cover 9, and a traveling controller 19 disposed forwardly of the driver's seat 12. These components together constitute the upper structure 36.

A portion of the swivel deck 2 forwardly of the driver's seat 12 is formed as a step 45. At a front portion of the swivel deck 2, via a receiving bracket 46, there is attached a swing bracket 48 of the excavator 37 to be pivotable about a vertical axis 47. In the excavator 37, the swing bracket 48 supported to the receiving bracket 46 via the vertical axis 47 is pivotable to the right or left by means of a swing cylinder. To this swing bracket 48, there are pivotally supported respective base ends of a boom 49 and a boom cylinder 50 so that the boom and the cylinder may be lifted up/down about a horizontal axis. Further, to the leading end of the boom 49, there is pivotally attached an arm 51, so that the arm 51 can be pivoted up/down by an arm cylinder 52. To the leading end of the arm 51, there is pivotally attached a bucket (implement) 53, so that the bucket can be operated by a bucket cylinder 54 for scooping or dumping operation.

The receiving bracket 46, as shown in FIGS. 6, 7 and 10-14, projects forwardly from the front face (extreme front end) of the swivel deck 2, forwardly of the traveling controller 19. The traveling controller 19 and the driver's seat 12 are disposed with an offset to either right or left (left side) from a centerline extending through the swivel axis X, whereas, the receiving bracket 46 is disposed with an offset to the opposite side (right side) relative to the same. The swivel deck 2 has a plan-view shape which is a front-square, rear-round shape consisting of a straight front side, straight parallel right and left sides and a round (arcuate) rear side. A distance from the swivel axis X of the swivel deck 2 to the leading end of the receiving bracket 46 or the vertical axis 47 is substantially same as or shorter than a distance from the swivel axis X to the rear end of the swivel deck 2. Preferably, these distances are substantially same as or shorter than a distance from the swivel axis X to the outer end of the crawler 39.

As this swiveling utility machine (backhoe) 1 is a compact type, the swivel deck 2 has an extremely small area and the front face of the driver's seat 12 is disposed substantially at the same position as the swivel axis X. As shown in FIGS. 9-14, the swivel deck 2 includes a base plate 2A as a base of the deck, a pair of right and left vertical walls 57 extending outward in the rear direction from the receiving bracket 46 at the front, a partitioning wall 58 mounted erect therebetween in such a manner as to traverse the right and left vertical walls 57, right and left receiving walls 59 mounted erect at a rear portion to be connected with the respective rear ends of the right and left vertical walls 57, and affaching stays mounted erect at intermediate portions and peripheral portions for attachment of various vehicle units and a peripheral cover to be mounted on the base plate 2A.

At a rear portion of the base plate 2A, the engine 3 is mounted with a lateral orientation to be fitted between the partitioning wall 58 and the right and left receiving walls 59. And, over and across this engine 3, there is disposed a support frame 4 having four posts. At a rear end of the base plate 2A, there is mounted an arcuate counter weight 56 via the right and left receiving walls 59. The support frame 4 is rectangular at its upper and front portions and is portal-shaped at its right and left and rear portions. Front left and right posts 4A, 4B are interconnected at lower portions thereof via an attaching plate 60A, and are detachably bolt-fixed via this attaching plate 60A to the top face of the partitioning wall 58.

Rear left and right posts 4C, 4D of the support frame 4 are also interconnected at lower portions thereof via an attaching plate 60B, and are detachably bolt-fixed to the left receiving wall 59. At an upper portion of the partitioning wall 58, there is formed a support portion 18A, to which a plate member is secured for receiving and supporting the attaching plate 60A. At upper portions of the right and left receiving walls 59, there are formed support portions 18B, to which a plate member is secured for receiving and supporting the attaching plate 60B. With these support portions 18A, 18B, the support frame 4 can be detachably attached to the base plate 2A from the above, with the engine 3 being mounted on the base plate 2A. As the components disposed around the engine 3 are supported to the support frame 4, there is no obstacle which may interfere with the engagement of the support frame 4 upwardly of the engine 3.

The support frame 4 includes a pair of right and left portal members each being formed portal with an L-shaped strip fixed thereto, thereby to form the front left and right posts 4A, 4B, the rear left and right posts 4C, 4D, and upper left and left sides 4E, 4F. The attaching plate 60A is secured to front lower ends of the right and left posts 4A, 4B of the two portal members. A front beam member (front upper beam) 61 formed by a strip member or by bending a strip member into an arcuate shape in its cross section is secured to the upper ends of the front left and right posts 4A, 4B. And, a rear beam member (rear upper beam) 62 formed of a thick plate is secured to the rear upper ends of the left and right sides 4E, 4F. Hence, the support frame 4 delimits an outer contour of an engine room. The front beam member 61 forms an attaching portion 61*a* for attaching a pivot member 63 for supporting the front portion of the driver's seat 12 to be pivotable about a horizontal axis. The rear beam member 62 forms an attaching portion (post attaching portion) 62*a* for attaching a post 13A of a driver's seat protecting unit 13 of a canopy (or a ROPS or sunshade).

The driver's seat 12 is adapted such that its rear portion is mounted and supported to the left and right sides 4E, 4F or the rear beam member 62 and its substantially entire area may be located above the support frame 4 and the engine 3, to allow its entire load to be supported by the support frame 4. As described above, this support frame 4 is the four-post type, thus providing high support strength, and can support the driver's seat 12 and the driver's seat protecting unit 13 firmly and reliably. To the support frame 4, there is fixed a fixed cover 6 covering the front and upper faces of the frame. This fixed cover 6 is formed of an L-shaped (side view) plate member (or two plates, i.e. a front plate and an upper plate). And, the cover 6 is bolt-fixed to the front left and right posts 4A, 4B, the front beam member 61 of the upper face and the left and right sides 4E, 4F of the support frame 4 and also engaged with the rear beam member 62 to be fastened to the driver's seat protecting unit 13 therewith.

An upper portion of the fixed cover 6 is engaged into the support frame 4 and an upper check window 90 is formed at this upper engaged portion. Further, the front portion of the cover 6 too is engaged into the support frame 4 and a front check window 91 is formed at this front engaged portion, with this front check window 91 being closed by a front lid.

Referring to FIGS. 9-12 and 21, the right side 4F of the support frame 4 includes an upper air guide plate 29A inclined downward in the right outer side. The right post 4B includes a front air guide plate 29B inclined rearward in the right outer side. So that, hot air from a radiator fan is guided to flow downward to the right in the rear direction.

Further, between the fixed cover 6 and the right post 4B and the right side 4F of the support frame 4, there is interposed a sealing member 28 for preventing hot air and noise from being leaked to the driver's seat 12 through the gap therebetween before being guided by the upper air guide plate 29A and the front air guide plate 29B. The two guide plates (upper air guide plate 29A, the front air guide plate 29B) are formed of e.g. sheet metal. Instead of or in addition thereto, a sealing member may be interposed also between the right edge of the fixed cover 6 and the components on the right side thereof, so as to prevent leak of hot air to the driver's seat 12. Within the support frame 4, and between this and the engine 3, various vehicle units as an air cleaner 10, a muffler 11, an oil filter 92, a reserve tank 93 etc. are disposed. And, these units are attached to the support frame 4 per se. Then, the support frame 4, with some of these vehicle units being assembled therewith, can be detachably attached to the base plate 2A from the above the engine 3.

On one right/left side (right side) of the engine 3, there is disposed the hydraulic pump 21 driven by the engine and on the other right/left side (left side) of the engine 3, there are disposed the radiator 5 and the radiator fan. On the outer side of the radiator 5, an oil cooler 64, a battery 65, etc. are disposed. These components are mounted on the base plate 2A, separately from the support frame 4. The radiator 5 is constructed as an air suction type and is mounted on the base plate 2A adjacent the left side of the support frame 4. And, the upper portion of the radiator 5 is connected and fixed via a bracket 16B to a support stay 16A projecting from the left side 4A to the outer side.

Referring to FIGS. 14-18, from the left side 4E, a plurality of stays 66 formed of plates or bars project to the outer side. And, via these stays 66, a base 14*a* of the left implement controller 14 is fixed. The base 14*a* is located on the left outer side of the radiator 5 and pivotally supports a lower pivot portion 70 of a device frame 69 of the left implement 14 via a pivot shaft 70*a* to be pivotable about a horizontal axis. The upper portion of the device frame 69 is formed like a box elongate in the fore and aft direction, and the lower pivot portion 70 supported on the pivot shaft 70*a* is formed narrow in the fore and aft direction. An urging means (coil spring) is engaged and fitted on the pivot shaft 70*a*, so as to urge the left implement controller 14 in a direction for switching it from an operational posture to an erect retracted posture.

Referring to the left implement controller 14, a pilot valve 72L operable by a left control lever 71L is attached to an upper portion of the device frame 69, and there is provided a posture switching means 74 which is operated by a posture switch lever 73.

The posture switch lever 73 is fixed to one end of a lever shaft 73*a* pivotally attached to the upper box portion of the device frame 69, and to the other end of the lever shaft 73*a*, a cam 77 having a cam groove 77*a* is fixed. Into the cam groove 77*a* of the cam 77, there is engaged a cam follower 78 provided in the base 14*a*. Further, at a deep portion of the cam groove 77*a*, an engaging recess 77*b* is formed. In operation, when the posture switch lever 73 is operated to pivot the device frame 69 about the pivot shaft 70*a* so that the cam 77 is moved relative to the cam follower 78 to bring the cam follower 78 to the deep side of the cam groove 77*a*, the left implement controller 14 is switched over from the retracted posture (position denoted with solid line in FIGS. 6 and 7) to the operational posture (position denoted with one-dot line in FIGS. 6 and 7). Then, the engaging recess 77*b* will engage with the cam follower 78, thereby to maintain the left implement controller 14 under the operational posture. Under this operational posture, the engagement between the engaging recess 77*b* and the cam follower 78 is maintained by an urging member 17 provided to the posture switch lever 73.

For the reverse switchover from the operational posture to the retracted posture, the posture switch lever 73 is pivoted upward against the urging force of the urging member 17. With this, the engaging recess 77*b* is disengaged from the cam follower 78, thereby to release the maintenance of the operational posture by the posture switch lever 73. Then, if the operator grips the posture switch lever 73 and moves this up, the left implement controller 14 is moved also upward. The urging member 17 which provides the pivotal force to the cam 77 in order to engage the engaging recess 77*b* with the cam follower 78 is disposed between the posture switch lever 73 and the rear portion of the box-like upper portion of the device frame 69. And, as this member is provided not in the vertical direction, but along he fore and aft direction at the box-like upper portion of the device frame 69, the lower pivot portion 70 is formed narrow in the fore and aft direction, so that this portion can be disposed inside a side cover 8.

The side cover 8 is disposed on the left outer side of the radiator 5, the oil cooler 64 and the battery 65 for covering these components, with the side cover 8 being detachably attached to the base plate 2A and the support frame 4. This side cover 8 has an ambient air inlet window and is engaged with a lower portion of the left implement controller 14 for covering up the pivot shaft 70*a* and the lower pivot portion 70.

Referring to FIGS. 3, 5-7, 10 and 12, the side cover 8 is open at its upper portion and houses and covers the lower pivot portion 70 of the left implement controller 14 therein. Further, as the left implement controller 14 is disposed as close as possible to the left side of the swivel deck 2, the swivel deck 2 is formed compact in the right/left dimension thereof.

The side cover 8 has its front face 8*a* disposed substantially flush with the front face 6*a* of the fixed cover 6 and this side cover 8 is supported via a vertical shaft (hinge) 79 to the left front post 4A of the support frame 4 (or the partitioning wall 58 raised from the base plate 2A) to be freely opened/closed. Further, its rear end is disposed adjacent the left end of a hood cover 7. The left implement controller 14 includes a cover 76 provided in the device frame 69. When the controller 14 with this cover 76 is under the retracted posture, its front face 76*a* (the front face of the left implement controller 14) is disposed substantially flush (substantially at a same position in the fore and aft direction) with the front face 8*a* of the side cover 8 and the front face 6*a* of the fixed cover 6 and the front face 12*a* of the driver's seat 12 too is disposed flush therewith.

Incidentally, any one or two of the fixed cover 6, the side cover 8, the driver's seat 12 and the left implement controller 14 maybe offset in the fore and aft direction relative to the others. In such case, it is preferred that it or they be offset rearward, rather than forward. And, by disposing the front face 8*a* of the side cover 8 as the wall erect behind the step 45 and the front face 6*a* of the fixed cover 6 in flush with each other, the area of the step 45 can be extended to facilitate a driver's access from the access entrance 20 to the driver's seat 12.

In FIGS. 3, 12, 19 and 20, to the right rear post 4D of the support frame 4 which is located on the right rear side of the engine 3 opposite to the side of the access entrance 20 and the radiator 5, a right end of the hood cover 7 is pivoted via a vertical shaft (hinge) 82 to be freely opened/closed.

The left end (free end) of this hood cover 7 is located adjacent the rear end (free end) of the side cover 8, so that these ends can be overlapped with each other via an edge seal member 32 from the outside. Then, by locking them with a lock provided between these and a counter weight 31 provided at the rear end of the swivel deck 2, opening of the side cover 8 can be prevented also. The plan-view shape of the hood cover 7 is an arcuate shape approximating the rear shape of the counter weight 31, and an edge seal 32 is provided along the peripheral edge of the hood cover 7 for sealing the gaps between the rear end of the side cover 8, the rear beam member 62 of the support frame 4 and the counter weight 31, thereby to prevent hot air and noise inside the engine room from being leaked through the hood cover 7.

Figure 3:
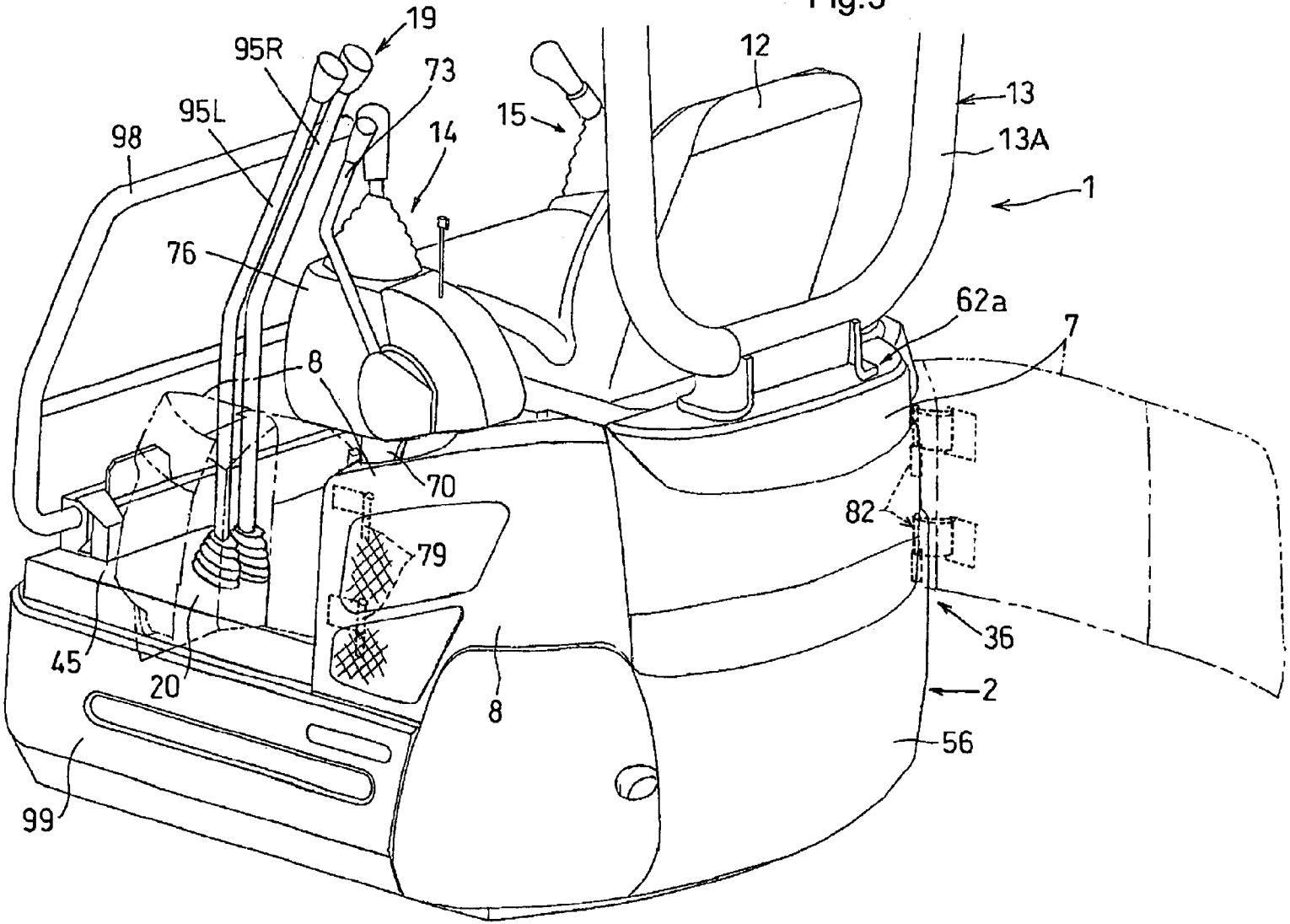
FIG. 3 is a perspective view showing an upper body of the swiveling utility machine as viewed from the left rear side thereof.
Figure 4:
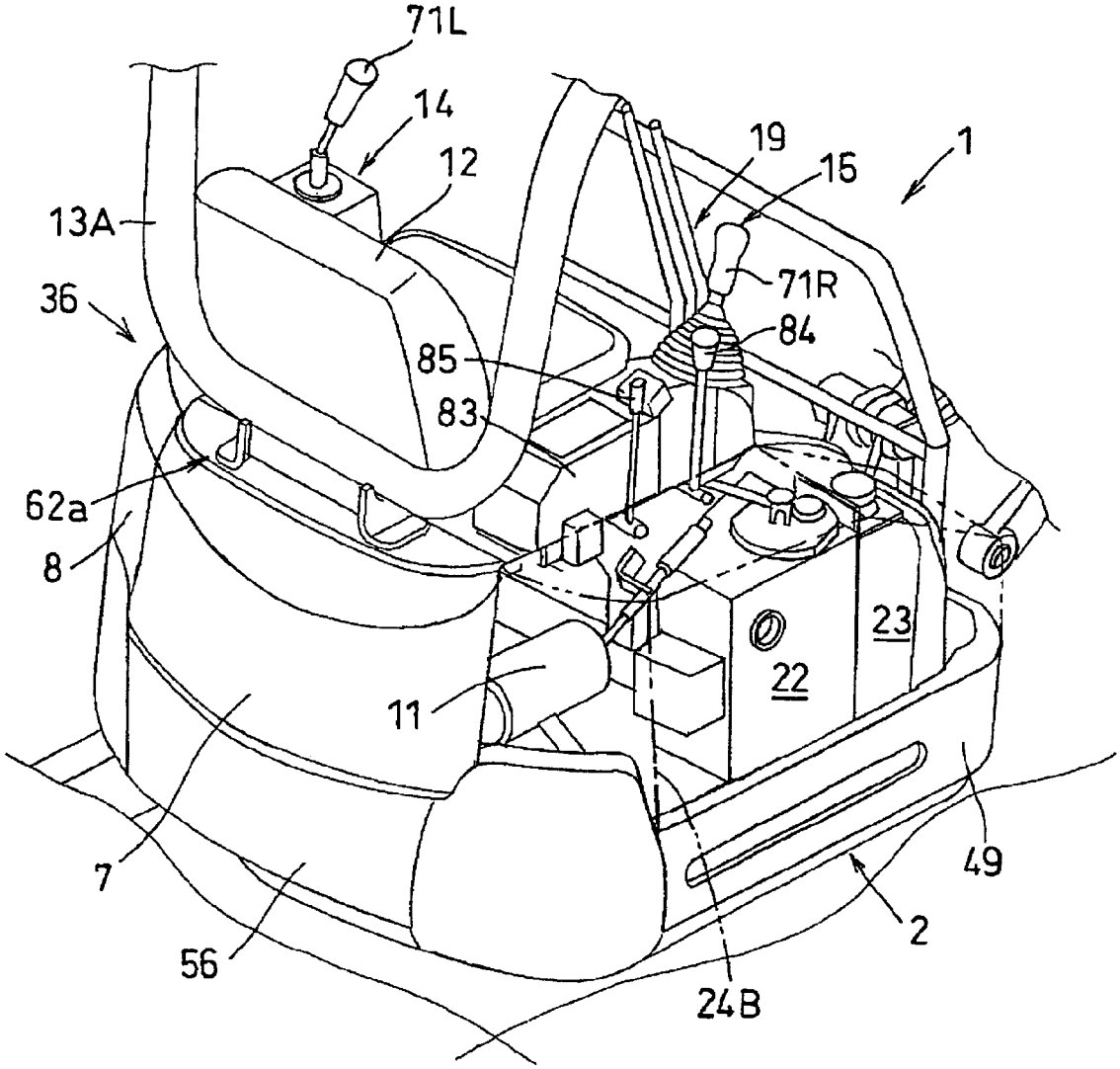
FIG. 4 is a perspective view of the same as viewed from the right rear side thereof.
Figure 5:
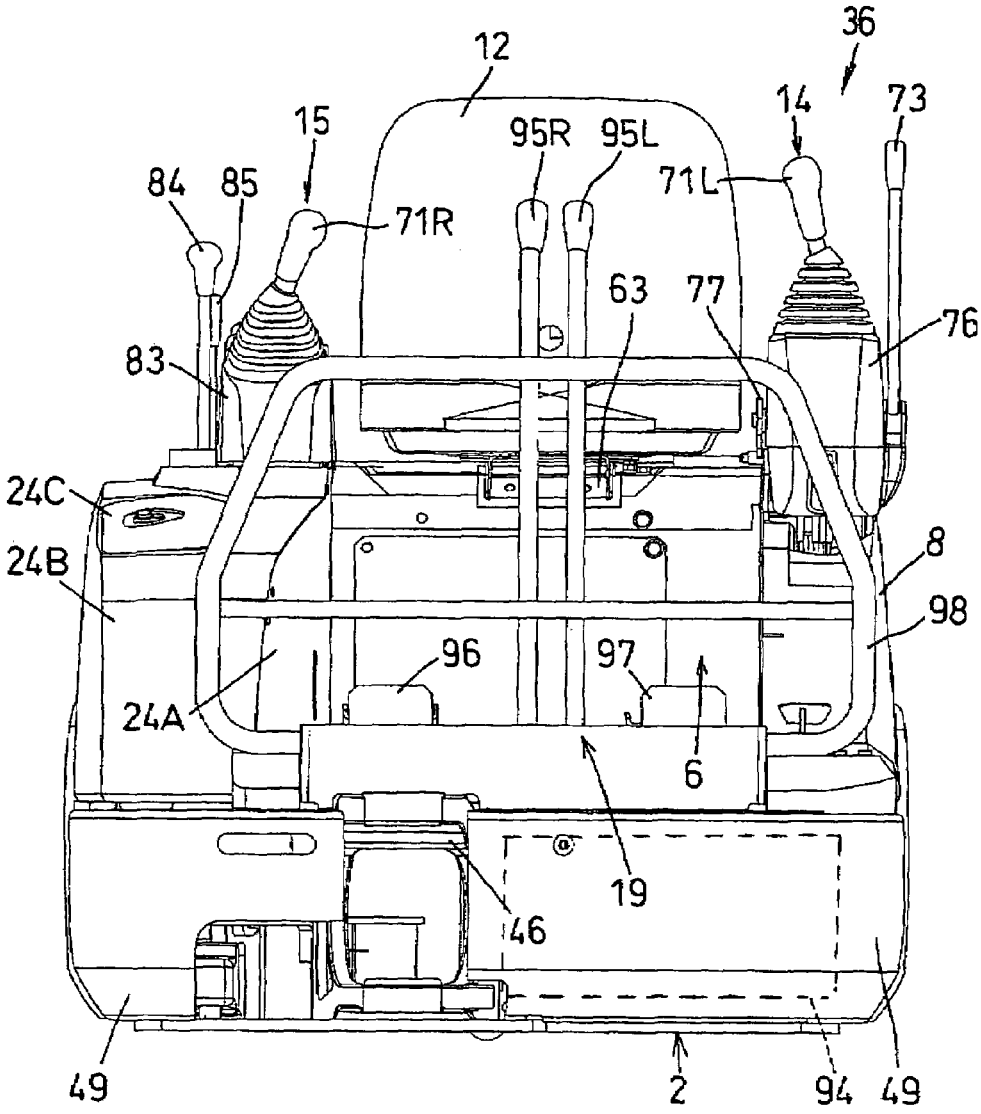
FIG. 5 is a front view of a swivel deck.
Figure 6:
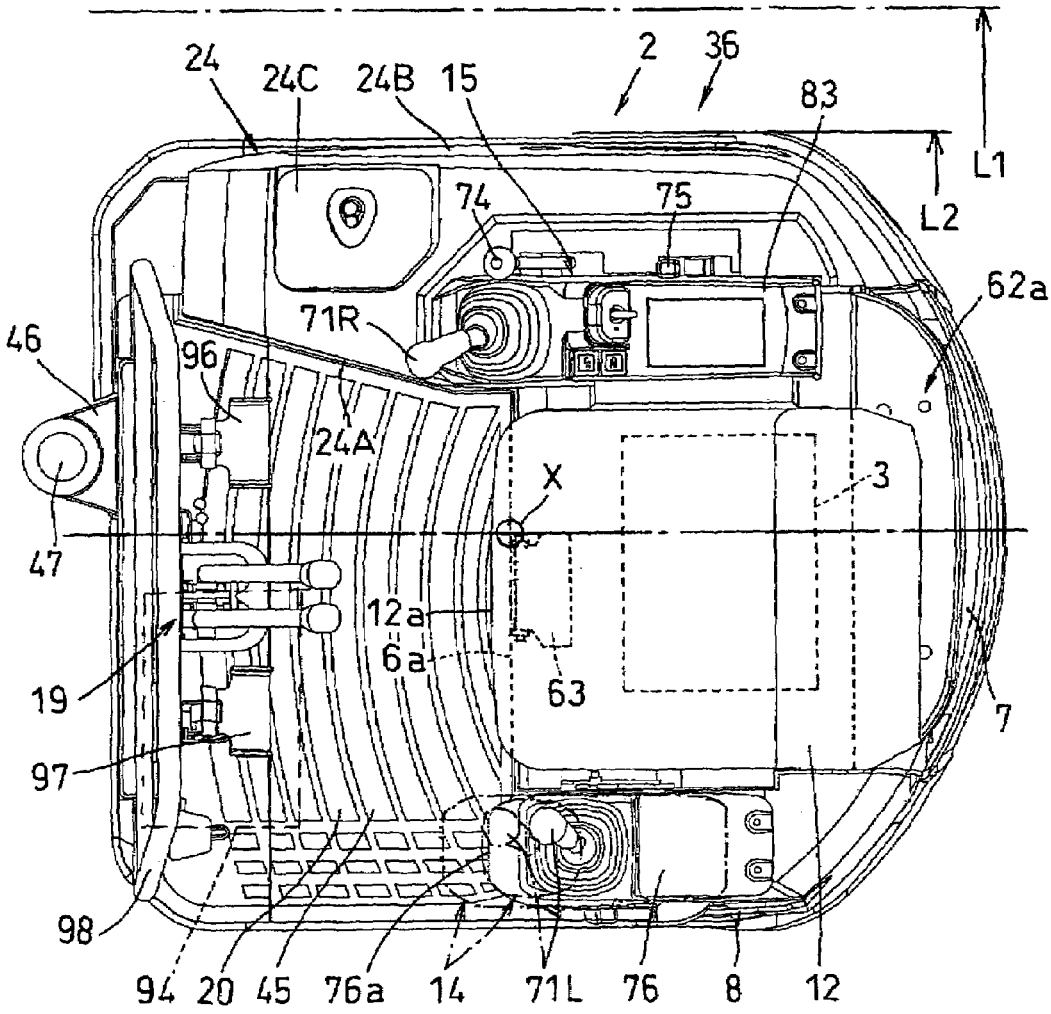
FIG. 6 is a plan view of the deck.
Figure 7:
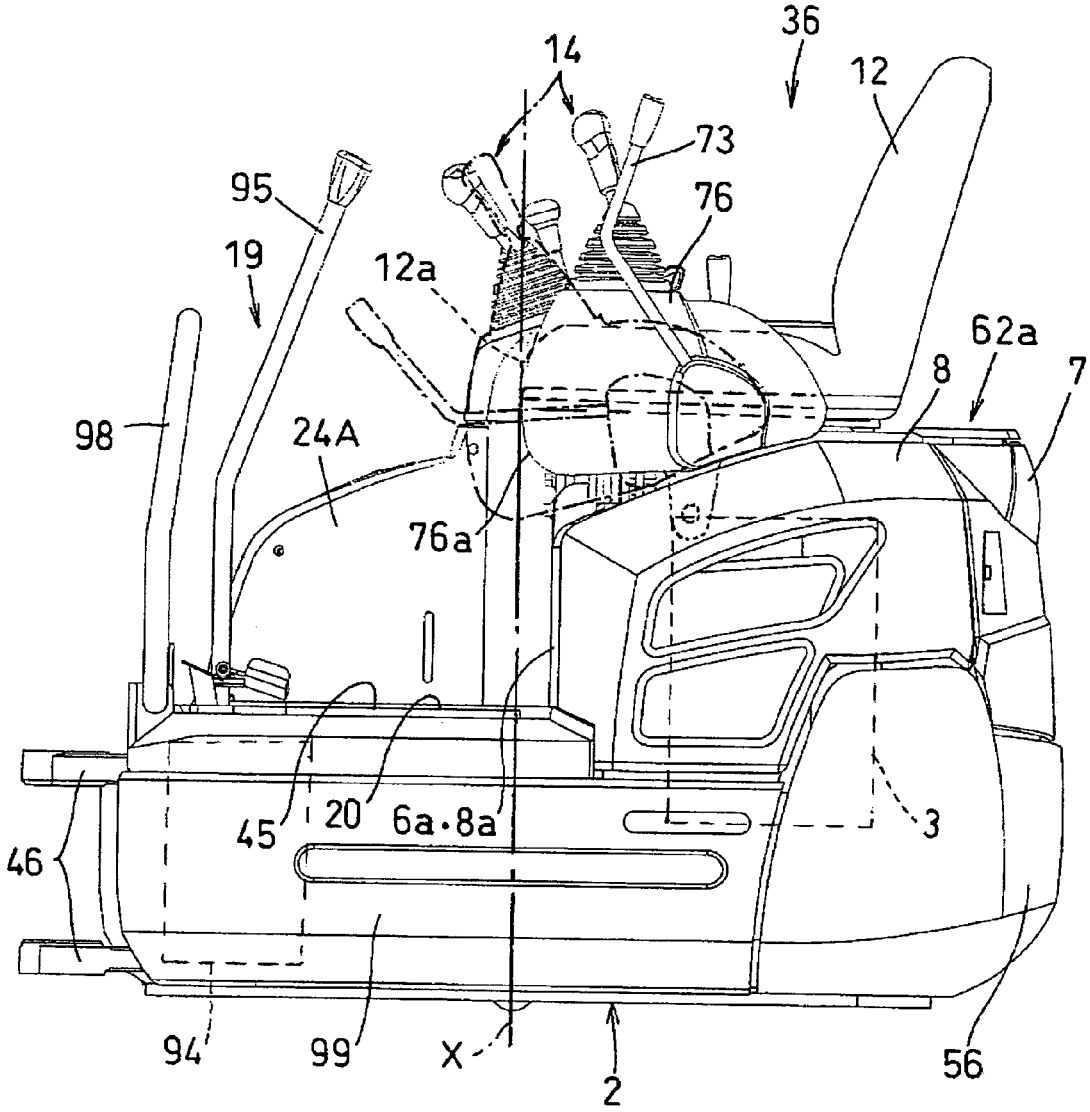
FIG. 7 is a left side view of the deck.
Figure 8:
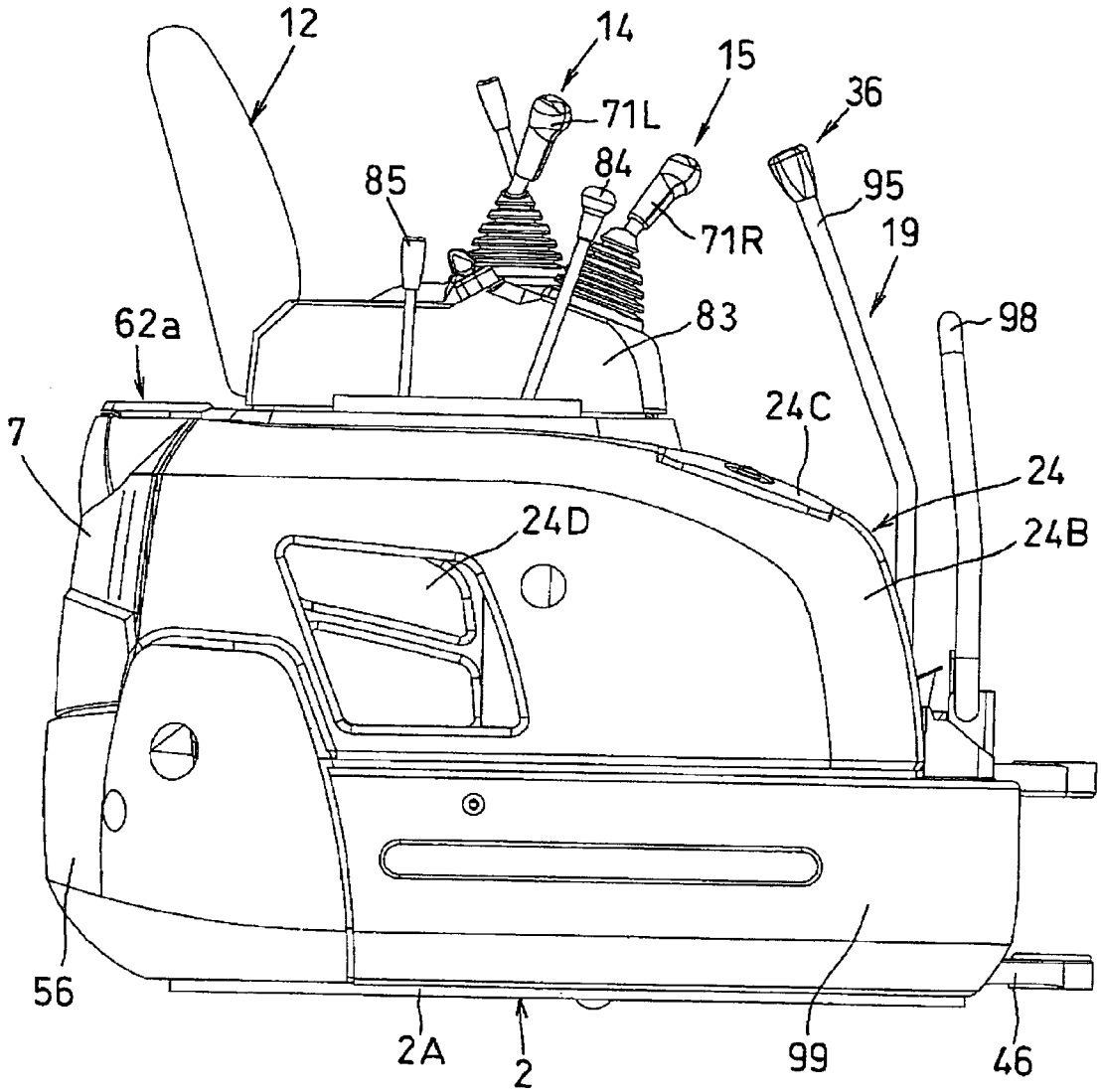
FIG. 8 is a right side view of the deck.
Figure 9:
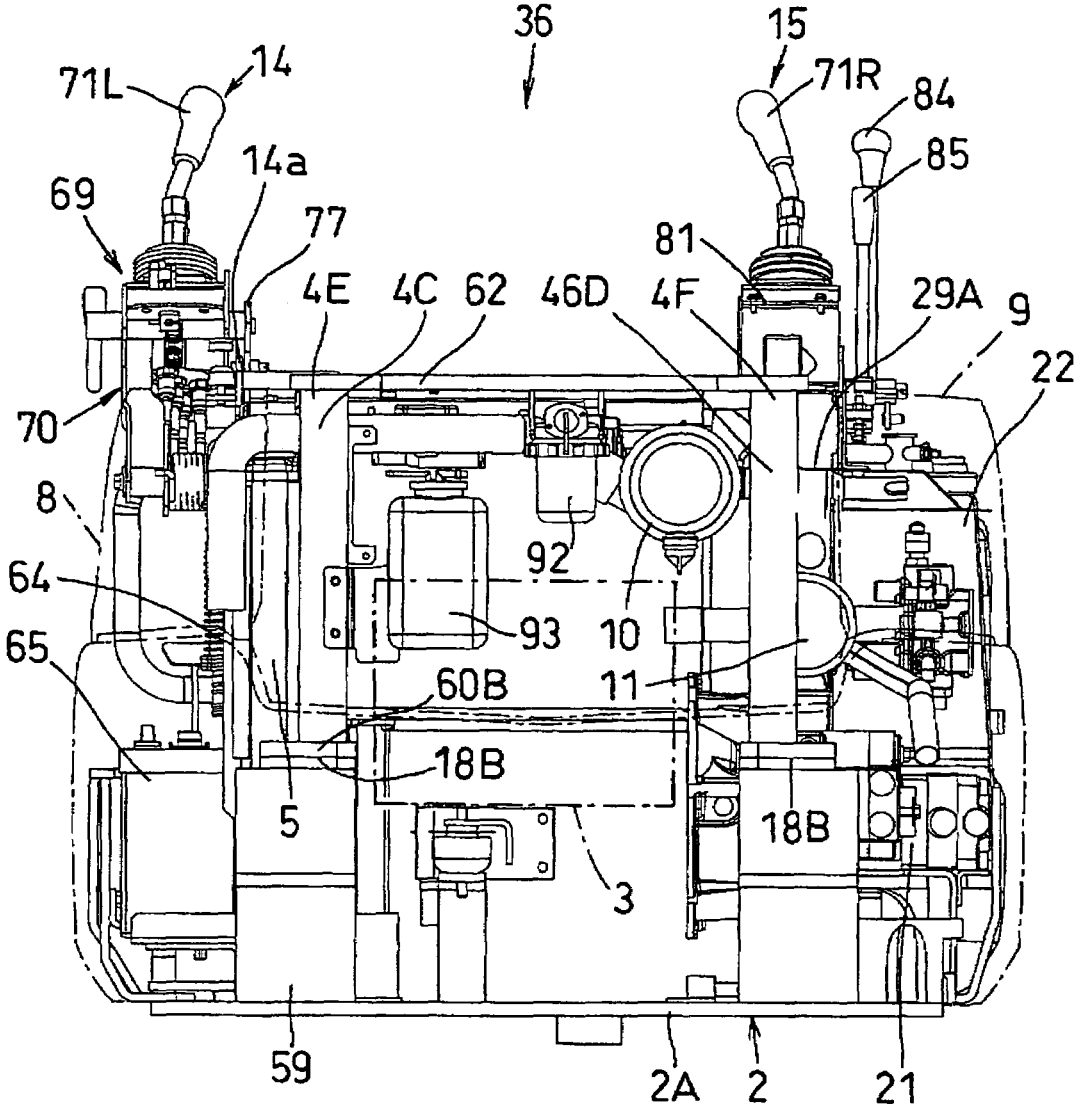
FIG. 9 is a rear view in section of the deck.
Figure 10:
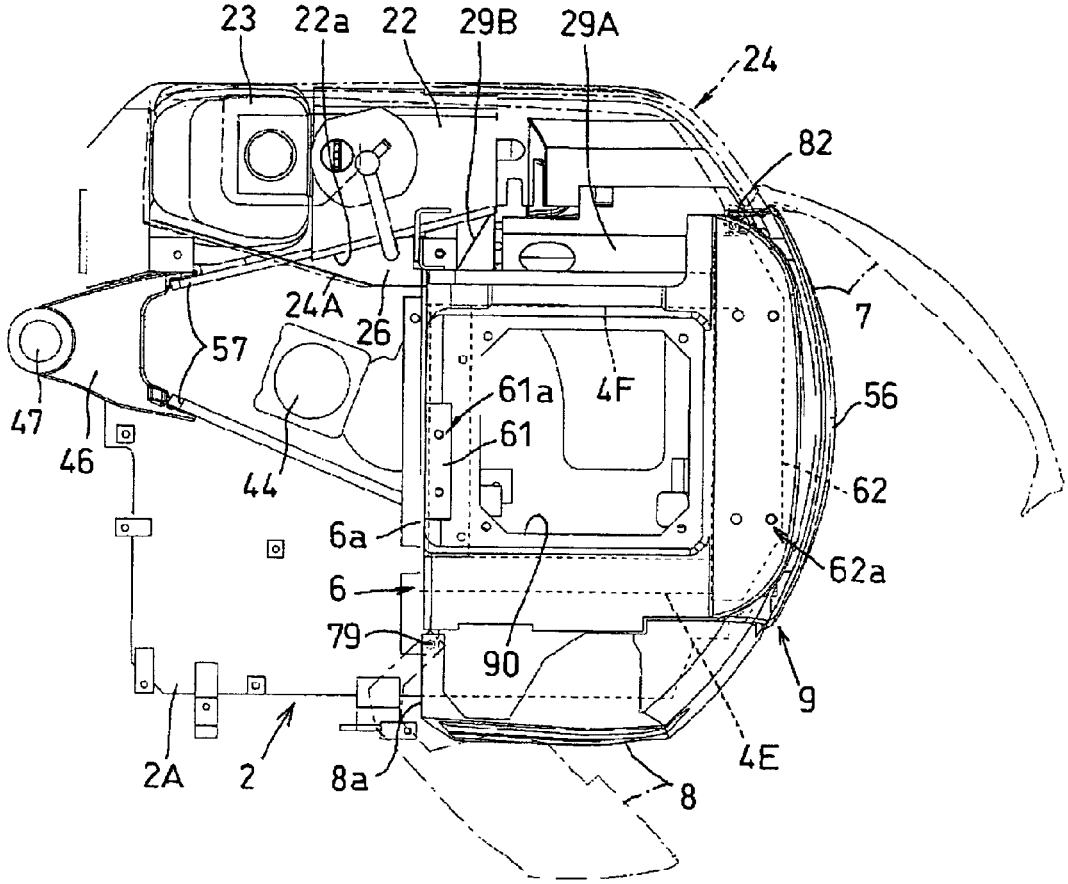
FIG. 10 is a plan view showing a cover unit for the swivel deck.
Figure 11:
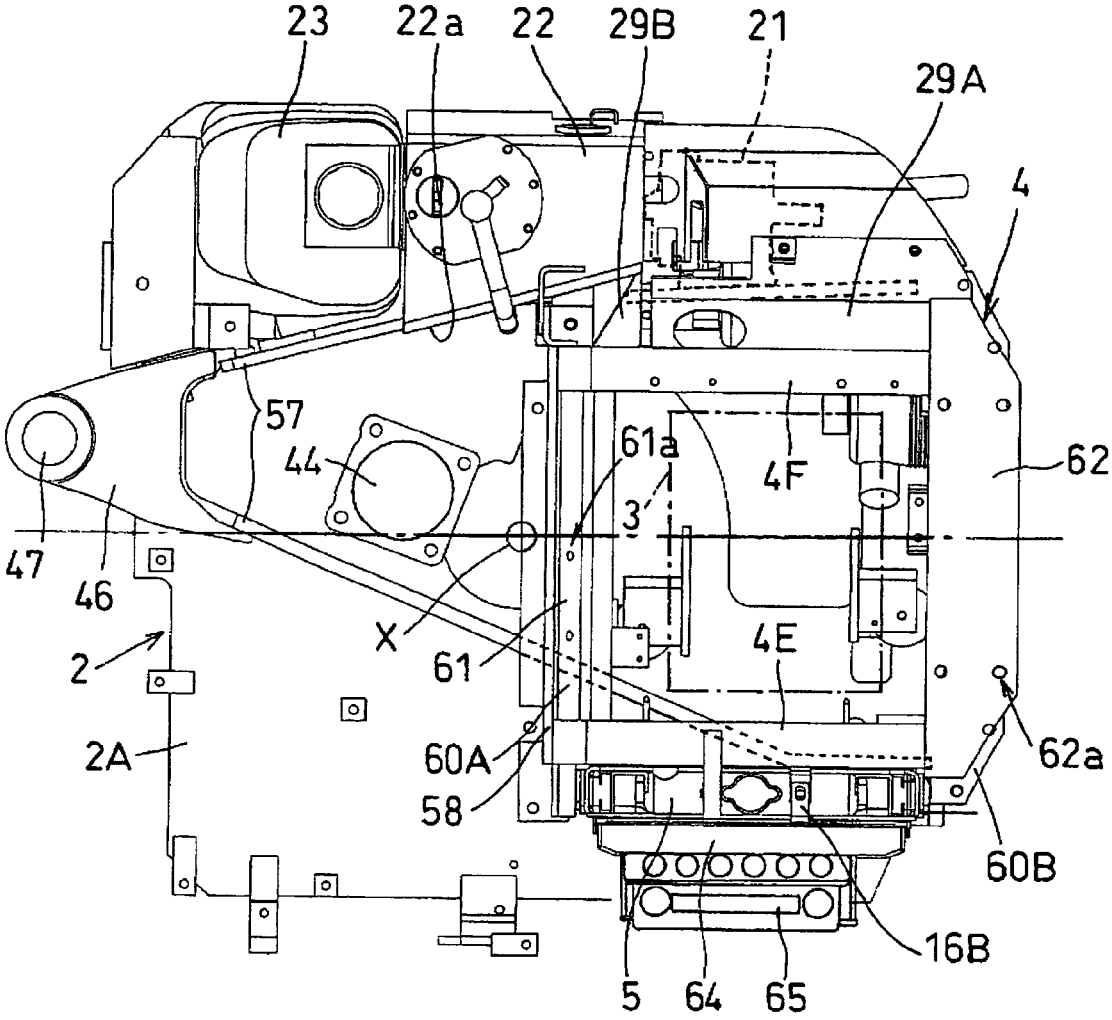
FIG. 11 is a plan view showing units mounted on the swivel deck.
Figure 12:
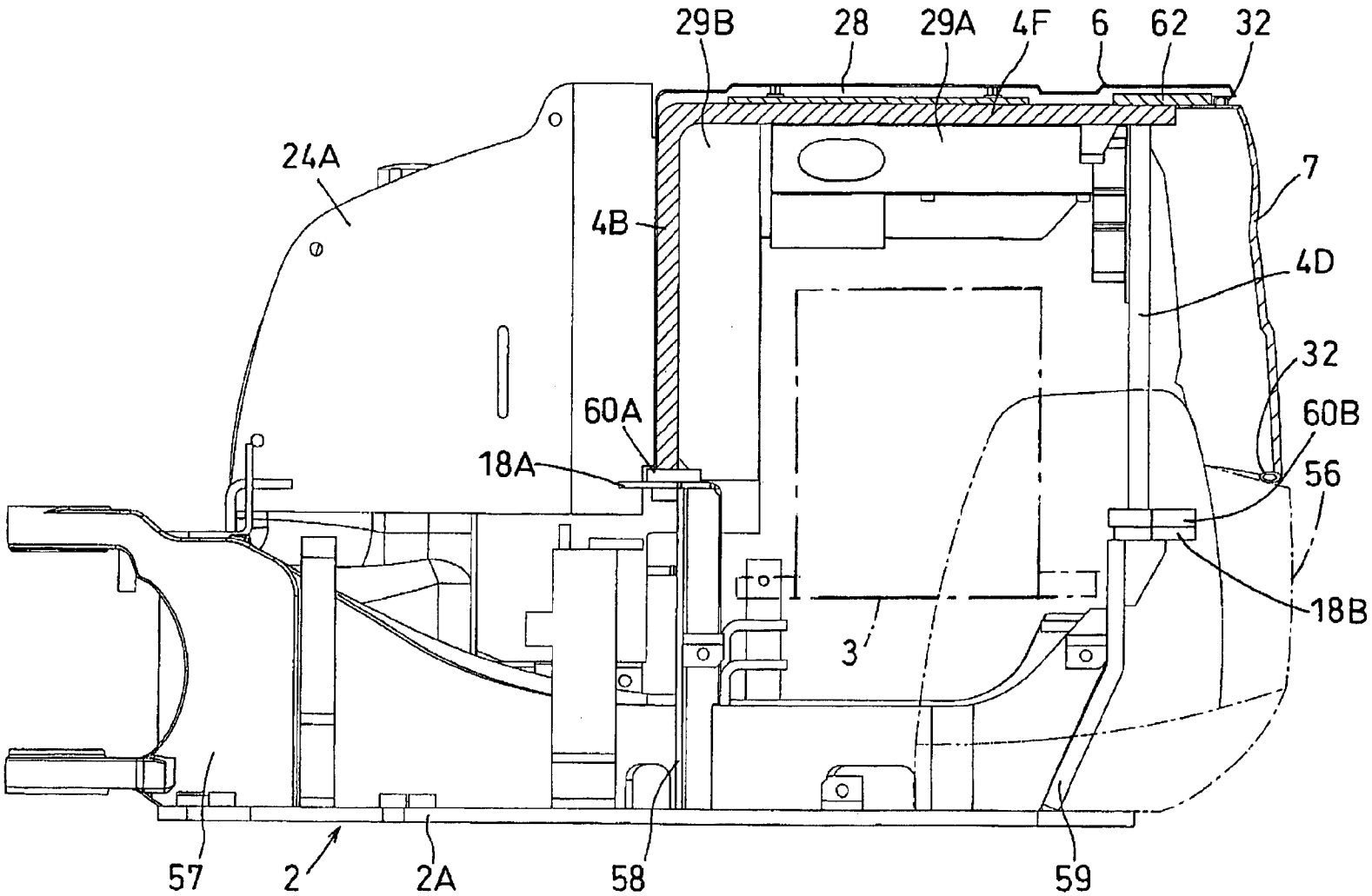
FIG. 12 is a side view in section showing an inner construction of the swivel deck.
Figure 13:
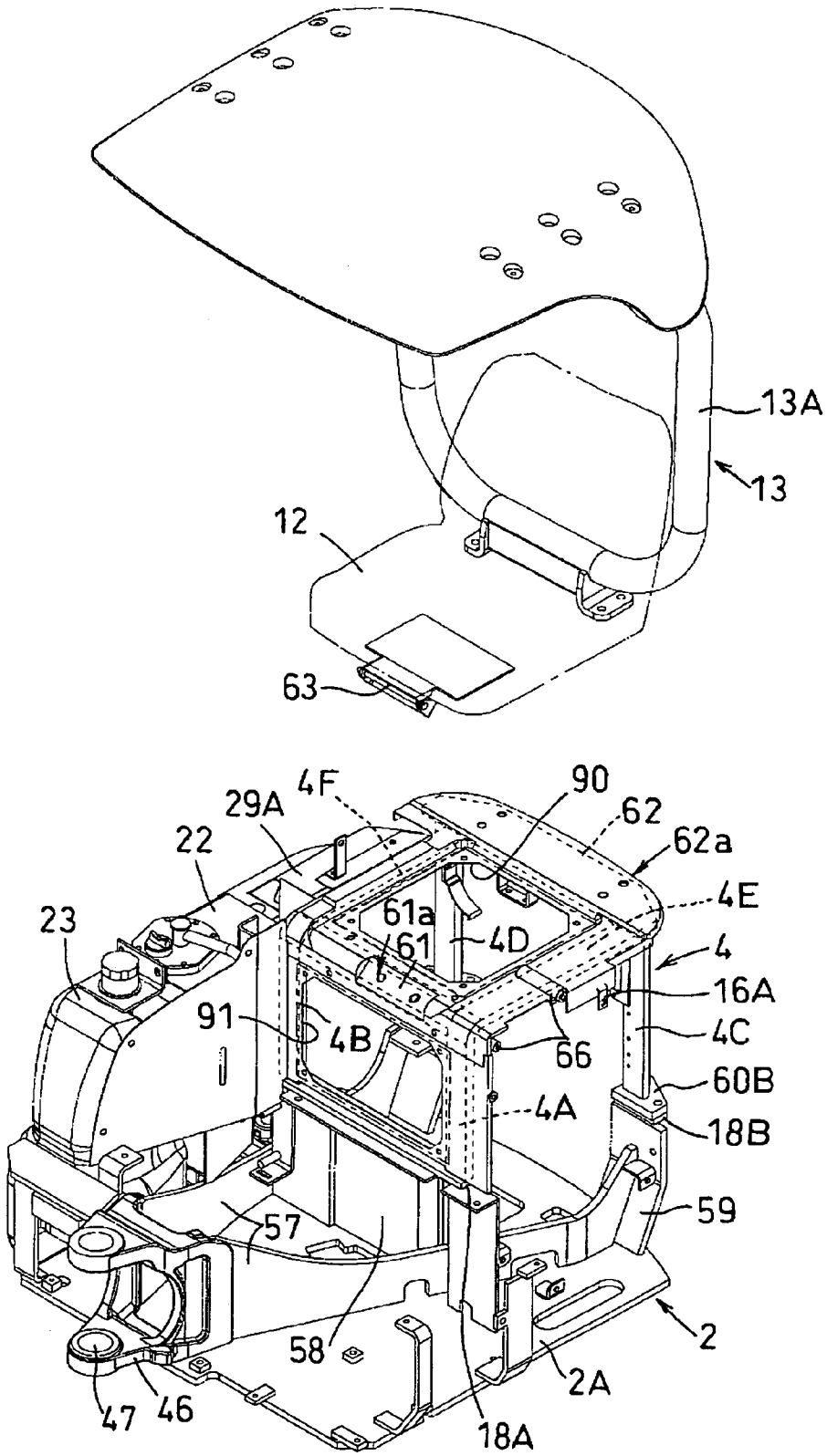
FIG. 13 is an exploded perspective view showing a mounting construction of the swivel deck for a driver's set and a canopy, as viewed from the left front side thereof.
Figure 14:
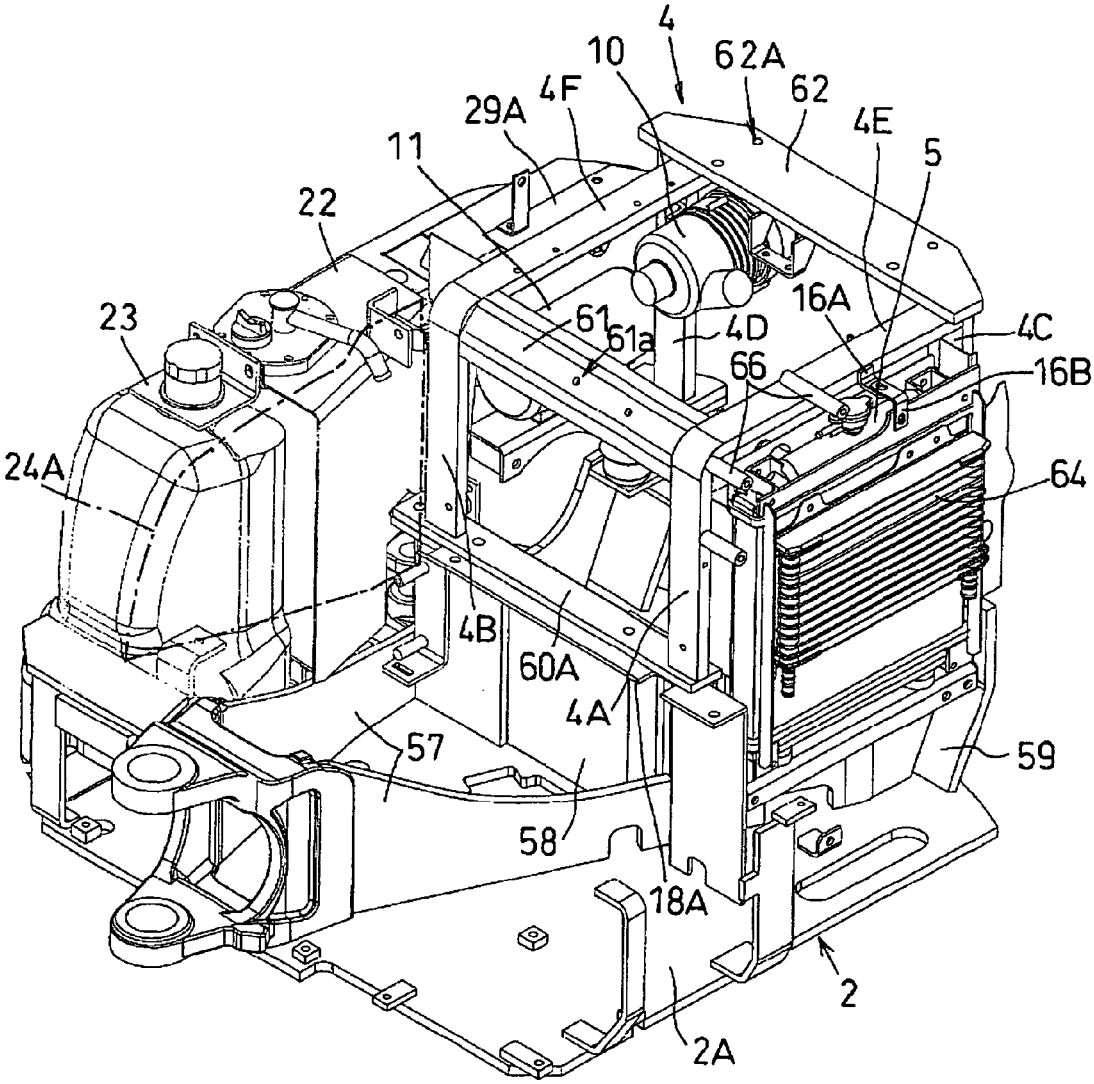
FIG. 14 is a perspective view showing the units mounted on the swivel deck.
Figure 15:
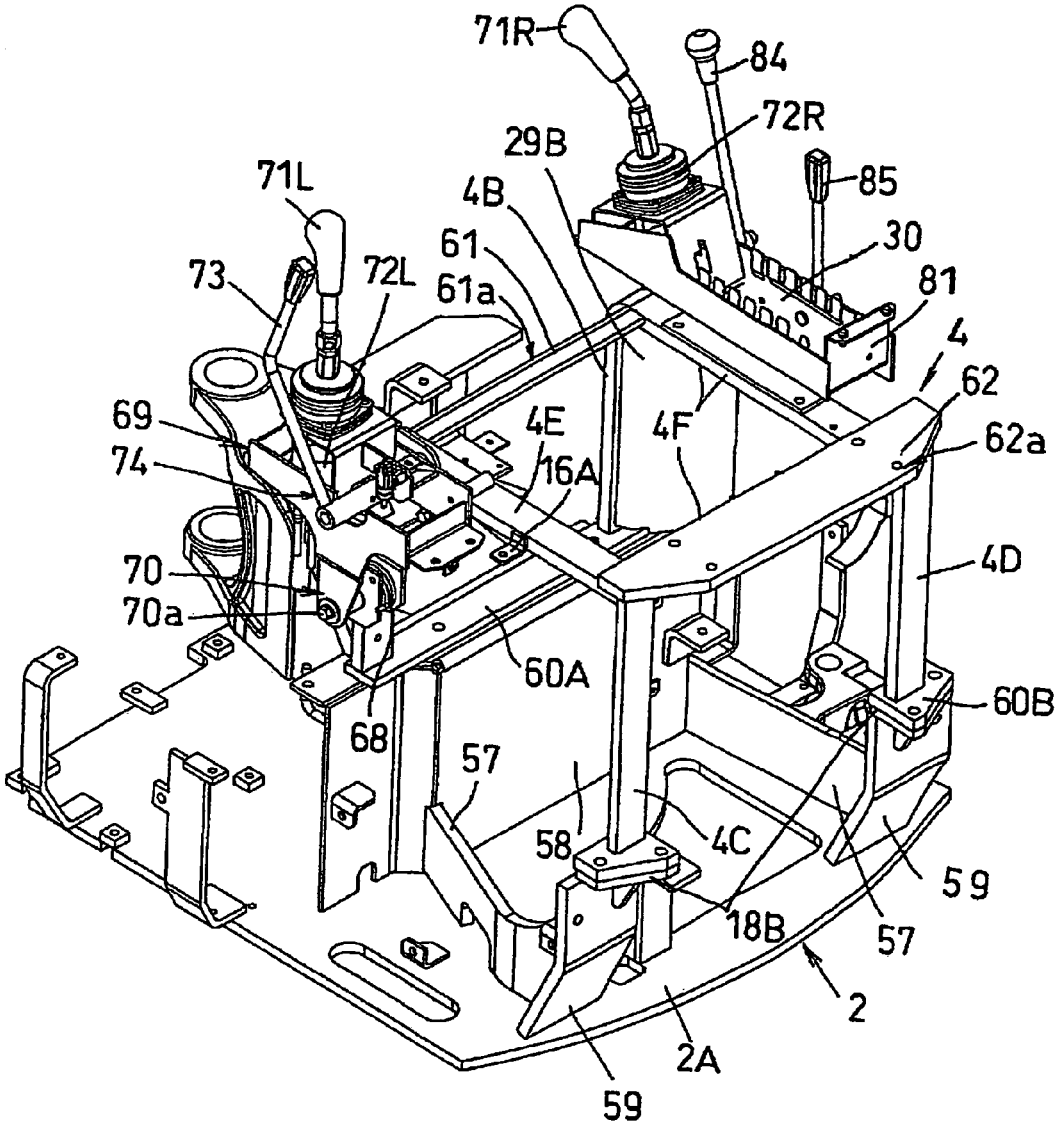
FIG. 15 is a perspective view showing relationship between a support frame and right and left implement controllers.
Figure 16:
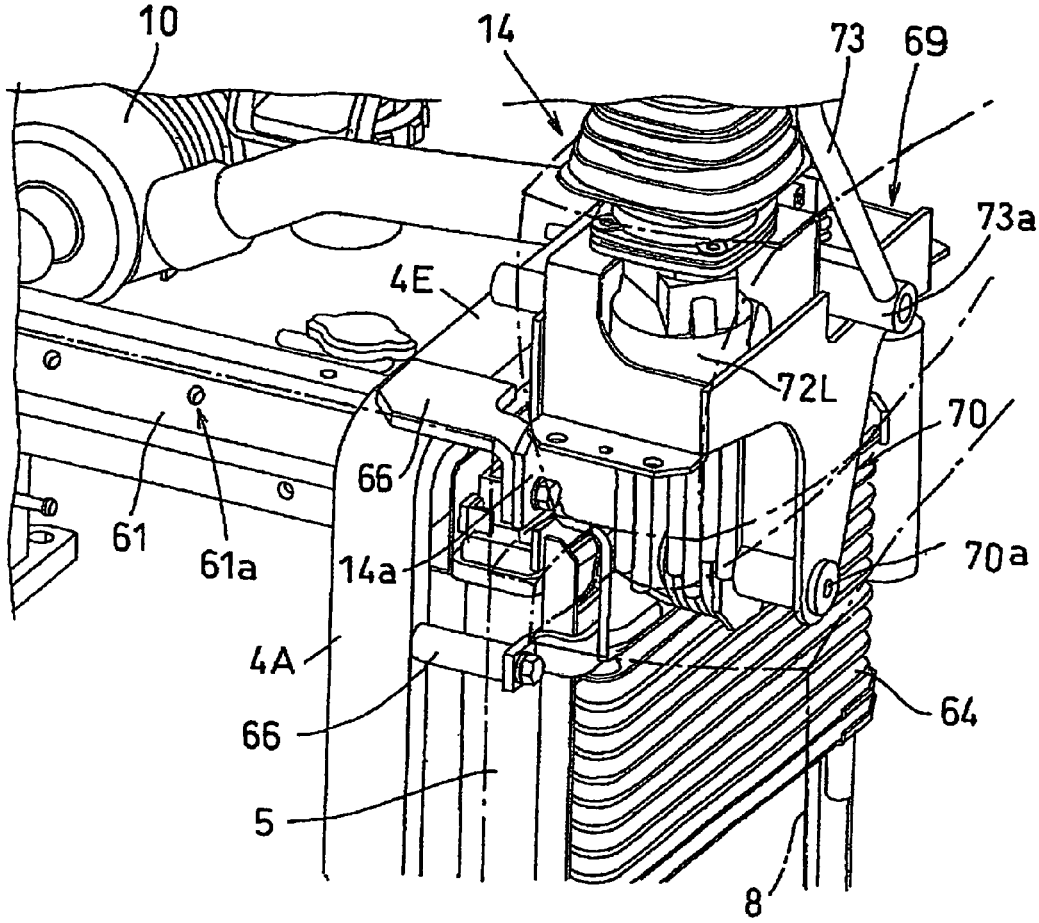
FIG. 16 is a perspective view showing the left implement controller and its vicinity, as viewed from the left front side thereof.
Figure 17:
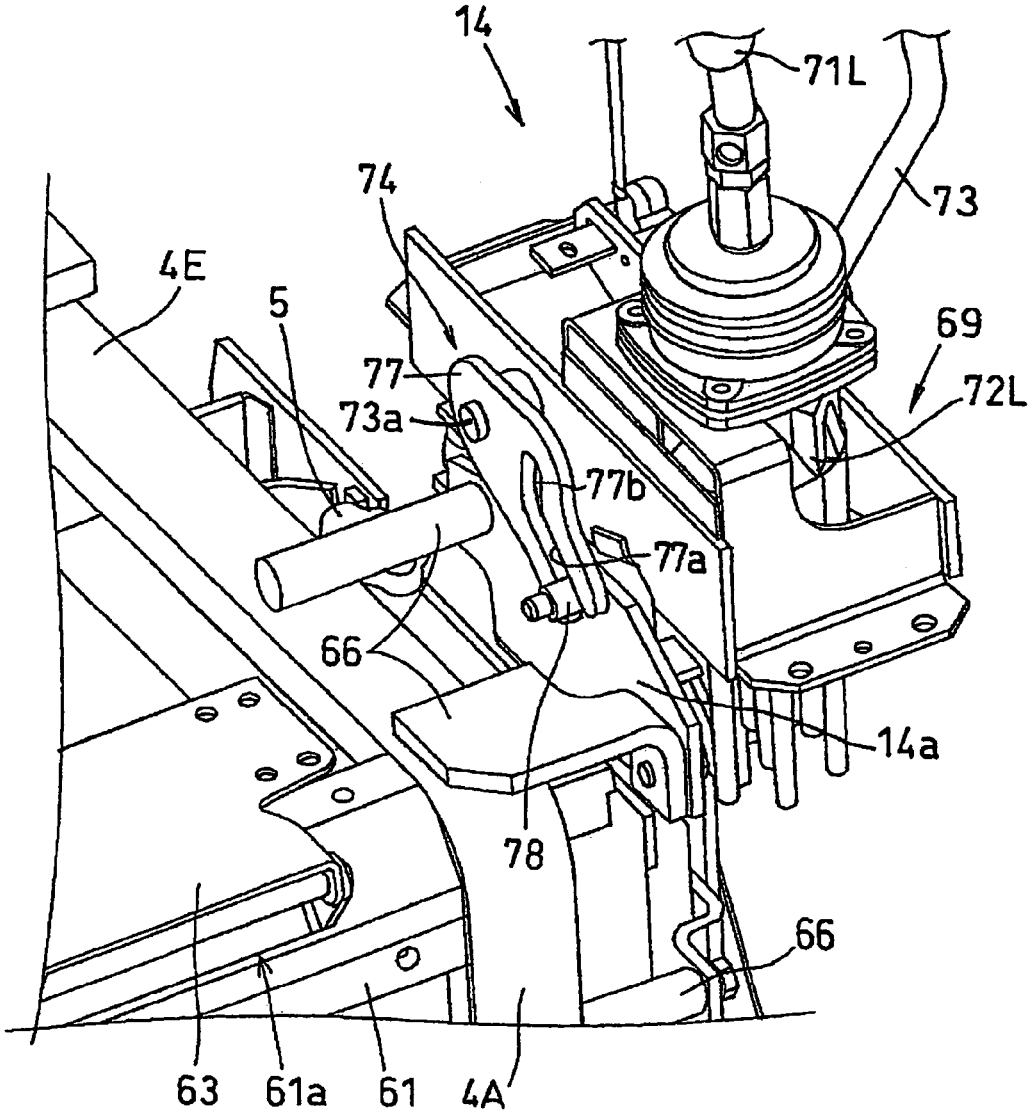
FIG. 17 is a perspective view showing the left implement controller and its vicinity, as viewed from the right front side thereof.
Figure 18:
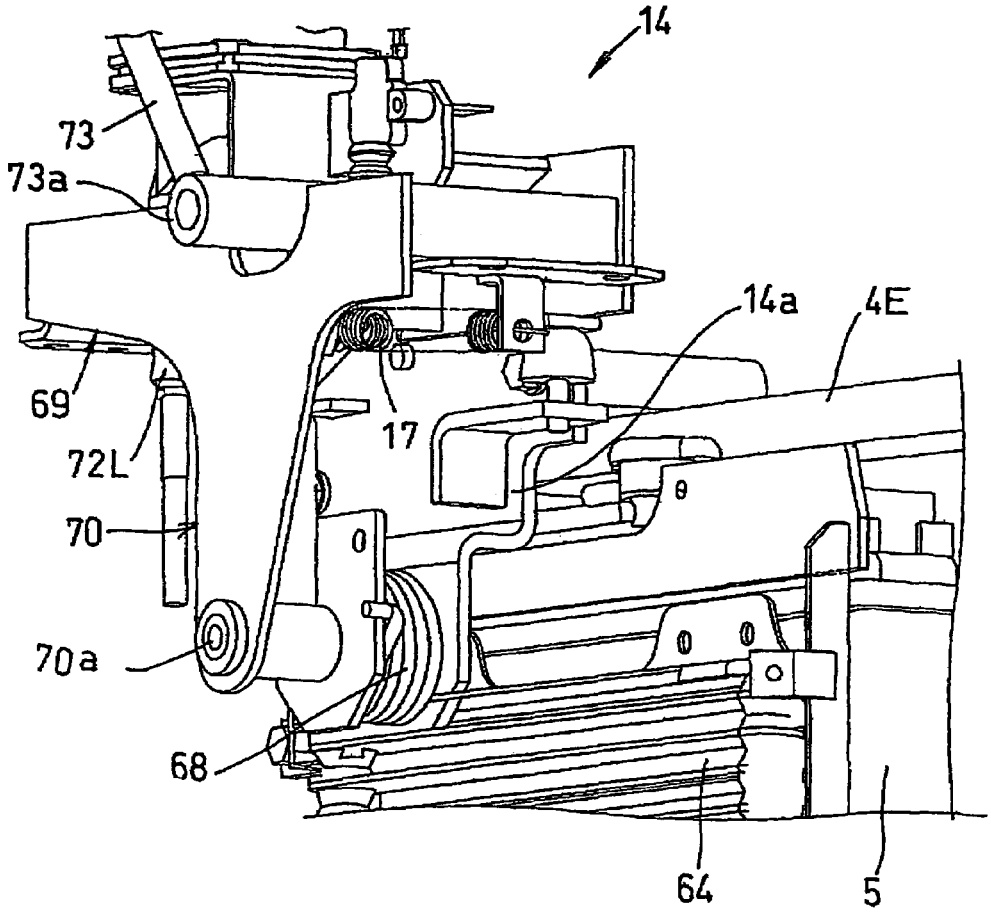
FIG. 18 is a perspective view showing the left implement controller and its vicinity, as viewed from the left rear side thereof.
Figure 19:
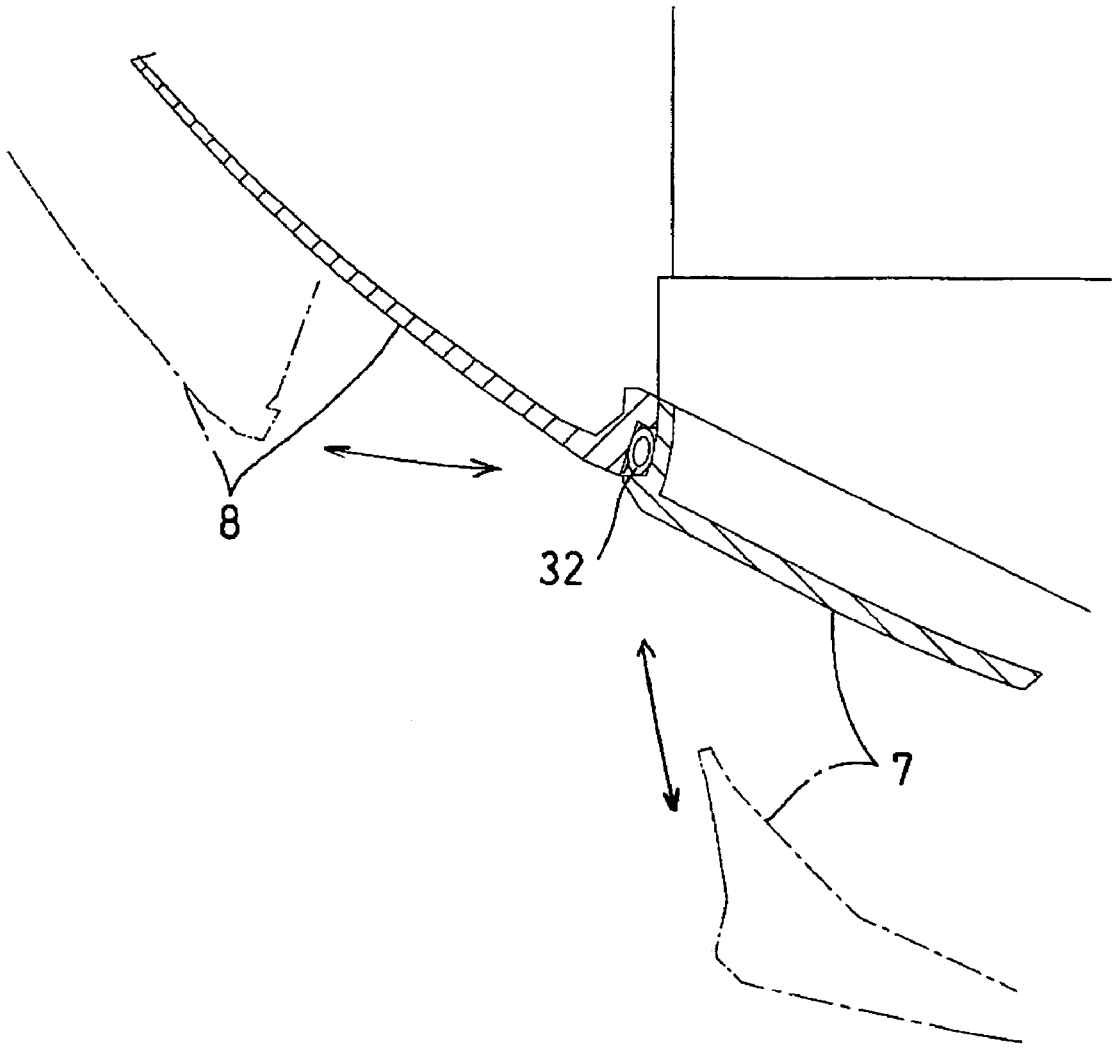
FIG. 19 is a plan view in section showing a hood cover, a side cover and their vicinities.
Figure 20:
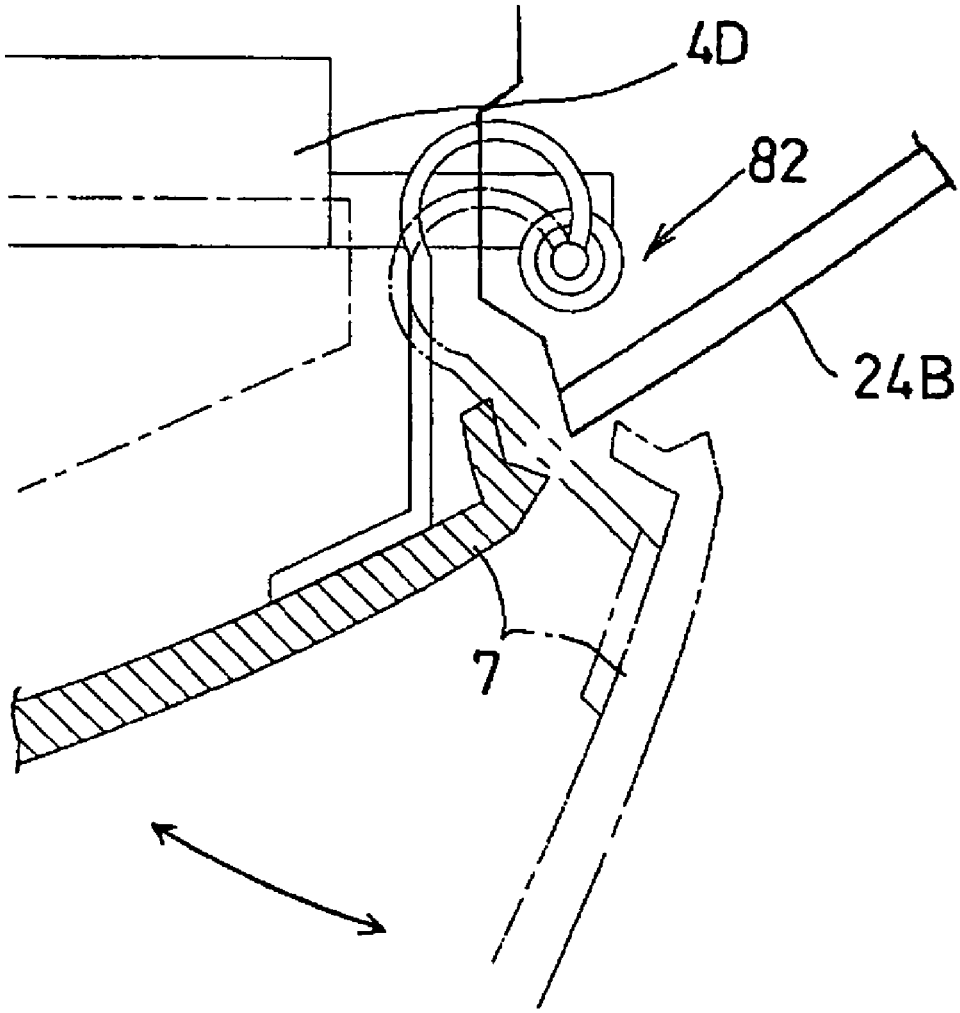
FIG. 20 is a plan view in section showing a pivot portion of the hood cover.
Figure 21:
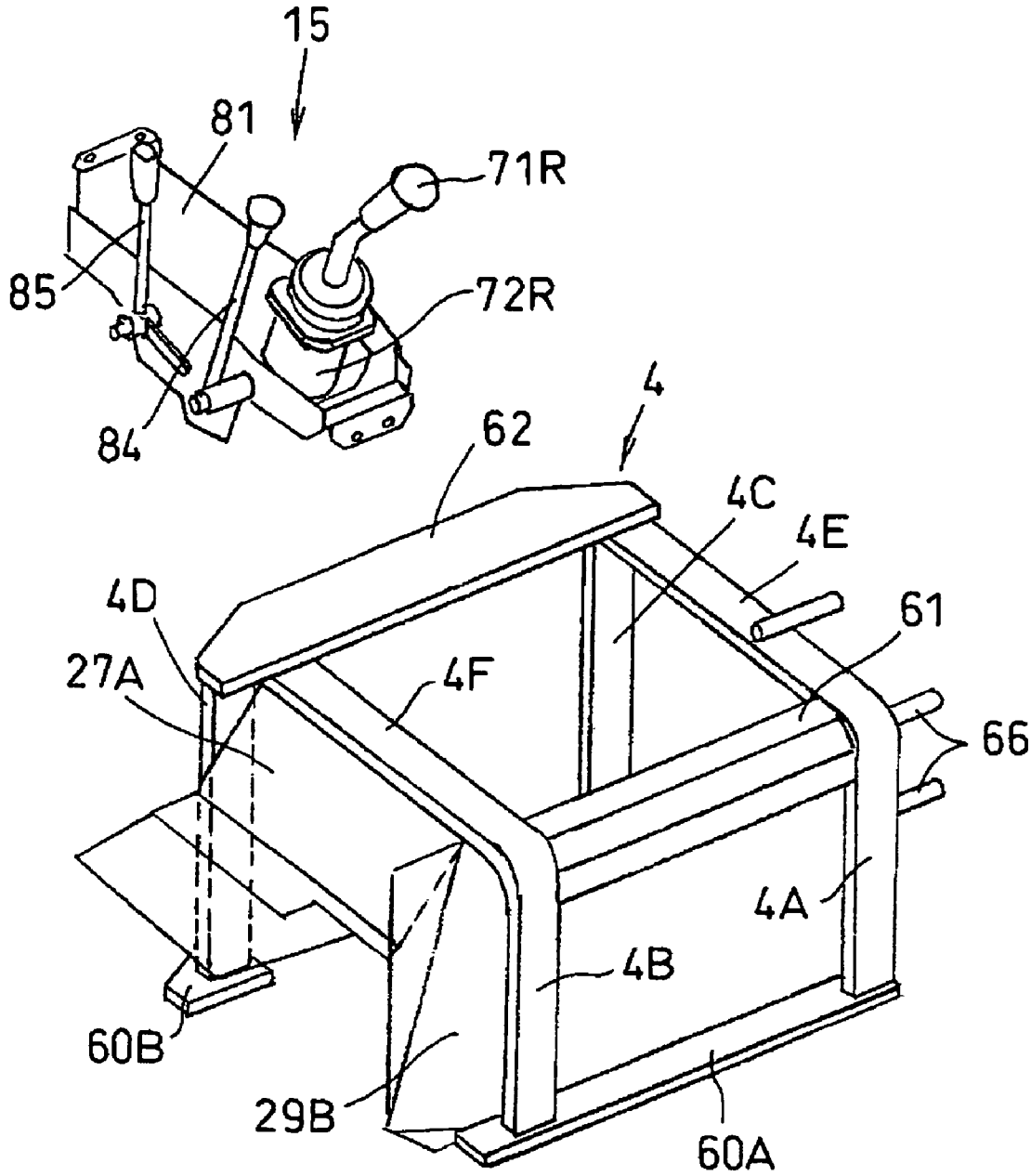
FIG. 21 is a perspective view of the support frame.

The hood cover 7 is pivotally supported at its right end and the side cover 8 is pivotally supported at its front side, to the support frame 4, respectively. Namely, these covers 7, 8 are pivotally attached via respective vertical axes on the near side and the opposite side, to be pivotally opened like double-doors. Therefore, by opening these like double-doors as shown in FIG. 3, the rear sides of the engine 3 and the radiator 5 and the lateral and upper sides of the radiator 5, the oil cooler 64 and the battery 65, etc. can be exposed. As a result, maintenance operations of the engine 3 and most of the vehicle components provided inside the engine room can be carried out easily. Further, as the hood cover 7 is constructed as a side open type, this hood cover can be opened wide without being interfered with by the driver's seat protecting unit 13 disposed upwardly thereof. And, this hood cover 7 can be opened independently, without opening the side cover 8.

On the right side of the engine 3, there is disposed the hydraulic pump 21 which receives a rotational force from a crank shaft of the engine 3. Forwardly of this hydraulic pump 21, the working oil tank 22 is disposed, and the fuel tank 23 is disposed forwardly of the working oil tank 22.

The right side 4F of the support frame 4 mounts, upwardly of the upper air guide plate 29A, a box 81 for the right implement controller 15. The box 81 includes, at a front portion thereof, a right pilot valve 72R having a right control lever 71R and supports, at its right side, two control levers 84, 85. The box 81 houses, at a rear portion thereof, electrical components 30. Adverse effect of hot air to the electrical components 30 is avoided by the upper air guide plate 29A which guides hot air from the inside of the engine room to the outside. Numeral 83 denotes a box cover for the box 81.

The working oil tank 22 and the fuel tank 23 are disposed on the right side of the driver's seat 12 and are covered with a tank cover 24. The front air guide plate 29B is disposed rearwardly of the working oil tank 22 for avoiding adverse effect of hot air to the working oil tank 22. The tank cover 24 includes an inner wall plate (side plate) 24A on the side of the step 45 and an outer cover 24B for covering the top faces and right side faces of the working oil tank 22 and the fuel tank 23 and the front face of the fuel tank 23. The inner wall plate 24A is secured to the base plate 2A and to the right post 4B of the support frame 4 or the right end of the fixed cover 6. And, this inner wall plate 24A projects forwardly from the support frame 4 to cover the left faces of the working oil tank 22 and the fuel tank 23.

The outer cover 24B covers the top faces, the right faces and front and rear faces of the working oil tank 22 and the fuel tank 23. And at its portion corresponding to the top of the fuel tank 23, a fuel inlet is formed and is closed by a lid 24C. On the right side of the cover 24B, there is formed an air exhaust portion 24D formed of a number of holes. The inner wall plate 24A and the face of the fuel tank 23 on the side of the step 45 are inclined to the right side as they extend forwardly, thus retaining a large front space on the step 45 for facilitating the operation of the traveling controller 19. Further, a side face 22*a* of the working oil tank 22 on the side of the step 45 is inclined to the right side as it extends rearward so as to form a substantially triangular space 26 between the inner wall plate 24A and the support frame 4, with the space 26 extending away therefrom rearwardly (shown in FIG. 10). Within this space 26, there are disposed hydraulic pipes and/or harness. With this centralized arrangement, installment and maintenance of the pipes are facilitated.

At a front upper portion of the base plate 2A of the swivel deck 2, there is mounted a control valve assembly 94 including a plurality of valves connected to each other in the right/left direction. The periphery of the base plate 2A is covered by a side cover 99 and the step 45 upwardly thereof includes a step plate attached on the base plate 2A and a mat placed on its top face.

The traveling controller 19 mounted at the front portion of the swivel deck 2 includes left and right traveling levers 95 (95L, 95R) and control pedals including a service port pedal 96 provided adjacent a driver's foot, a swing pedal 97, etc. Further, a front handrail 98 is provided forwardly of these.

Incidentally, FIGS. 1-21 show the best modes of the specific shapes of the respective components and their fore-and-aft, right/left and upper/lower arrangements in the foregoing embodiment. However, the present invention is not limited thereto. Various independent modifications of these components and arrangements as well as various combinations thereof are also possible.

For instance, the swiveling utility machine 1 can be constructed as a super-compact swivel type having a boom pivotally mounted at the center of the swivel deck 2. The swivel deck 2 and the components mounted thereon may be arranged on the respective opposite sides in the right/left direction.

The support frame 4 can include five or more posts. The hood cover 7 can be an upper pivot type. The side cover 8 can be a rear-end pivot type or detachable type.

Moreover, the driver's seat 12 can be adjustable in position in the fore and aft direction. Instead of the driver's seat protecting unit 13, a cabin may be mounted on the swivel deck 2.

The present invention may be embodied in any other manner than described above. Various modifications thereof will be apparent for those skilled in the art without departing from the essential concept thereof defined in the appended claims.

The invention claimed is:

1. A swiveling utility machine having a swivel deck comprising:

a support frame disposed at a rear portion of the swivel deck in such a manner as to create a rectangular space on the swivel deck;

an engine mounted within the rectangular space;

a driver seat disposed upwardly of the support frame;

a radiator disposed adjacent the engine;

a right implement controller secured to a right side of the support frame;

a left implement controller attached to a left side of the support frame to be switchable in its posture between an operational posture and a retracted posture;

an access step disposed at a front portion of the support frame;

an access entrance provided on a left side of the access step, and wherein a fixed cover is attached to a front face of the support frame, a side cover for covering the radiator is attached to the left side of the support frame and a front face of the side cover, a front face of the fixed cover and a front face of the left implement controller at its retracted posture are arranged side by side substantially in a same plane.

2. The swiveling utility machine according to claim 1, wherein said support frame includes four posts.

3. The swiveling utility machine according to claim 1, wherein a lower pivot portion of the left implement controller is disposed inside the side cover.

4. The swiveling utility machine according to claim 1, wherein a stay extending over and across the radiator projects from the left side of the support frame, and a lower pivot portion of the left implement controller is supported at a portion of the stay on the outside of the radiator.

5. The swiveling utility machine according to claim 1, wherein on the side of the engine opposite to the access entrance, a hydraulic pump is disposed and a working oil tank and a fuel tank are disposed forwardly of the hydraulic pump and laterally of the driver seat.

6. The swiveling utility machine according to claim 1, wherein a front face and an upper face of the engine are covered by the fixed cover and a rear face of the engine is covered by an openable/closable hood cover, an air-inlet side of the radiator is covered by the side cover, the side cover being openable/closable, and a hydraulic pump, a working oil tank and a fuel tank are covered by a tank cover.

7. A swiveling utility machine having a swivel deck comprising:

a support frame disposed at a rear portion of the swivel deck in such a manner as to create a rectangular space on the swivel deck;

an engine mounted within the rectangular space;

a driver seat disposed upwardly of the support frame;

a radiator disposed adjacent the engine;

a left implement controller attached to a left side of the support frame;

a right implement controller attached to a right side of the support frame, one of said left implement and said right implement controller being switchable in its posture between an operational posture and a retracted posture;

an access step disposed at a front portion of the support frame;

an access entrance provided on one lateral side of the access step adjacent to said one switchable implement controller, and wherein a fixed cover is attached to a front face of the support frame, a side cover for covering the radiator is attached to one lateral side of the support frame adjacent to said one implement controller, and wherein a front face of the side cover, a front face of the fixed cover and a front face of said one implement controller at its retraced posture are arranged side by side substantially in a same plane.

8. The swiveling utility machine according to claim 7, wherein said support frame includes four posts.

9. The swiveling utility machine according to claim 7, wherein a lower pivot portion of said one implement controller is disposed inside the side cover.

10. The swiveling utility machine according to claim 7, wherein a stay extending over and across the radiator projects from one lateral side of the support frame adjacent to said one implement controller, and a lower pivot portion of said one implement controller is supported at a portion of the stay on the outside of the radiator.

11. The swiveling utility machine according to claim 7, wherein on the side of the engine opposite to the access entrance, a hydraulic pump is disposed and a working oil tank and a fuel tank are disposed forwardly of the hydraulic pump and laterally of the driver seat.

12. The swiveling utility machine according to claim 7, wherein a front face and an upper face of the engine are covered by a fixed cover and a rear face of the engine is covered by an openable/closeable hood cover, an air-inlet side of the radiator is covered by the side cover, the side cover being openable/closable and a hydraulic pump, a working oil tank and a fuel tank are covered by a tank cover.

13. A swiveling utility machine having a swivel deck comprising:

a support frame disposed at a rear portion of the swivel deck in such a manner as to create a rectangular space on the swivel deck;

an engine mounted within the rectangular space;

a driver seat disposed upwardly of the support frame;

a radiator disposed adjacent the engine;

a right implement controller secured to a right side of the support frame;

a left implement controller attached to a left side of the support frame to be switchable in its posture between an operational posture and a retracted posture;

an access step disposed at a front portion of the support frame;

an access entrance provided on a left side of the access step, and wherein a stay extending over and across the radiator projects from the left side of the support frame, and a lower pivot portion of the left implement controller is supported at a portion of the stay on the outside of the radiator.

14. The swiveling utility machine according to claim 13, wherein said support frame includes four posts.

15. The swiveling utility machine according to claim 13, wherein the lower pivot portion is disposed inside a side cover for covering the radiator.

16. The swiveling utility machine according to claim 13, wherein on the side of the engine opposite to the access entrance, a hydraulic pump is disposed and a working oil tank and a fuel tank are disposed forwardly of the hydraulic pump and laterally of the driver seat.

17. The swiveling utility machine according to claim 13, wherein a front face and an upper face of the engine are covered by a fixed cover and a rear face of the engine is covered by an openable/closable hood cover, an air-inlet side of the radiator is covered by an openable/closable side cover, and a hydraulic pump, a working oil tank and a fuel tank are covered by a tank cover.

18. A swiveling utility machine having a swivel deck comprising:

a support frame disposed at a rear portion of the swivel deck in such a manner as to create a rectangular space on the swivel deck;

an engine mounted within the rectangular space;

a driver seat disposed upwardly of the support frame;

a radiator disposed adjacent the engine;

a left implement controller attached to a left side of the support frame;

a right implement controller attached to a right side of the support frame, one of said left implement and said right implement controller being switchable in its posture between an operational posture and a retracted posture;

an access step disposed at a front portion of the support frame;

an access entrance provided on one lateral side of the access step adjacent to said one switchable implement controller, and wherein a stay extending over and across the radiator projects from one lateral side of the support frame adjacent to said one implement controller, and a lower pivot portion of said one implement controller is supported at a portion of the stay on the outside of the radiator.

19. The swiveling utility machine according to claim 18, wherein said support frame includes four posts.

20. The swiveling utility machine according to claim 18, wherein the lower pivot portion of said one implement controller is disposed inside a side cover for covering the radiator.

21. The swiveling utility machine according to claim 18, wherein on the side of the engine opposite to the access entrance, a hydraulic pump is disposed and a working oil tank and a fuel tank are disposed forwardly of the hydraulic pump and laterally of the driver seat.

22. The swiveling utility machine according to claim 18, wherein a front face and an upper face of the engine are covered by a fixed cover and a rear face of the engine is covered by an openable/closeable hood cover, an air-inlet side of the radiator is covered by an openable/closeable side cover, and a hydraulic pump, a working oil tank and a fuel tank are covered by a tank cover.

23. A swiveling utility machine having a swivel deck comprising:

a support frame disposed at a rear portion of the swivel deck in such a manner as to create a rectangular space on the swivel deck;

an engine mounted within the rectangular space;

a driver seat disposed upwardly of the support frame;

a radiator disposed adjacent the engine;

a right implement controller secured to a right side of the support frame;

a left implement controller attached to a left side of the support frame to be switchable in its posture between an operational posture and a retracted posture;

an access step disposed at a front portion of the support frame;

an access entrance provided on a left side of the access step, and wherein a front face and an upper face of the engine are covered by a fixed cover and a rear face of the engine is covered by an openable/closable hood cover, an air-inlet side of the radiator is covered by an openable/closable side cover, and a hydraulic pump, a working oil tank and a fuel tank are covered by a tank cover.

24. The swiveling utility machine according to claim 23, wherein said support frame includes four posts.

25. The swiveling utility machine according to claim 23, wherein a lower pivot portion of the left implement controller is disposed inside the side cover.

26. The swiveling utility machine according to claim 23, wherein on the side of the engine opposite to the access entrance, the hydraulic pump is disposed and the working oil tank and the fuel tank are disposed forwardly of the hydraulic pump and laterally of the driver seat.

27. A swiveling utility machine having a swivel deck comprising:

a support frame disposed at a rear portion of the swivel deck in such a manner as to create a rectangular space on the swivel deck;

an engine mounted within the rectangular space;

a driver seat disposed upwardly of the support frame;

a radiator disposed adjacent the engine;

a left implement controller attached to a left side of the support frame;

a right implement controller attached to a right side of the support frame, one of said left implement and said right implement controller being switchable in its posture between an operational posture and a retracted posture;

an access step disposed at a front portion of the support frame;

an access entrance provided on one lateral side of the access step adjacent to said one switchable implement controller, and wherein a front face and an upper face of the engine are covered by a fixed cover and a rear face of the engine is covered by an openable/closeable hood cover, an air-inlet side of the radiator is covered by an openable/closeable side cover, and a hydraulic pump, a working oil tank and a fuel tank are covered by a tank cover.

28. The swiveling utility machine according to claim 27, wherein said support frame includes four posts.

29. The swiveling utility machine according to claim 27, wherein a lower pivot portion of said one implement controller is disposed inside the side cover.

30. The swiveling utility machine according to claim 27, wherein on the side, of the engine opposite to the access entrance, the hydraulic pump is disposed and the working oil tank and the fuel tank are disposed forwardly of the hydraulic pump and laterally of the driver seat.

* * * * *

UNITED STATES PATENT AND TRADEMARK OFFICE

CERTIFICATE OF CORRECTION

PATENT NO. : 7,320,380 B2
APPLICATION NO. : 10/945557
DATED : January 22, 2008
INVENTOR(S) : Ueda et al.

It is certified that error appears in the above-identified patent and that said Letters Patent is hereby corrected as shown below:

Column 5, Line 38, “affaching stays” should read -- attaching stays --

Signed and Sealed this

First Day of July, 2008

JON W. DUDAS
*Director of the United States Patent and Trademark Office*